US009927729B2

(12) United States Patent
Mine et al.

(10) Patent No.: US 9,927,729 B2
(45) Date of Patent: Mar. 27, 2018

(54) TONER AND PRODUCING METHOD THEREFOR

(71) Applicant: Konica Minolta, Inc., Tokyo (JP)

(72) Inventors: Tomoko Mine, Hino (JP); Kaori Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/080,040

(22) Filed: Mar. 24, 2016

(65) Prior Publication Data

US 2016/0306286 A1 Oct. 20, 2016

(30) Foreign Application Priority Data

Apr. 16, 2015 (JP) ..... 2015-084151

(51) Int. Cl.
*G03G 9/087* (2006.01)
*G03G 9/08* (2006.01)

(52) U.S. Cl.
CPC ..... *G03G 9/08711* (2013.01); *G03G 9/0804* (2013.01); *G03G 9/08755* (2013.01); *G03G 9/08786* (2013.01); *G03G 9/08791* (2013.01); *G03G 9/08797* (2013.01)

(58) Field of Classification Search
CPC ..... G03G 9/08755; G03G 9/08711; G03G 9/08786; G03G 9/08784; G03G 9/08791; G03G 9/08797
USPC ..... 430/109.3, 109.4
See application file for complete search history.

(56) References Cited

U.S. PATENT DOCUMENTS

| | | | | |
|---|---|---|---|---|
| 2015/0037722 | A1* | 2/2015 | Yamazaki | G03G 9/08 430/108.4 |
| 2015/0037728 | A1* | 2/2015 | Moribe | G03G 9/08755 430/109.4 |
| 2015/0037729 | A1* | 2/2015 | Yoshiba | G03G 9/08755 430/109.4 |

FOREIGN PATENT DOCUMENTS

| | | | |
|---|---|---|---|
| JP | 2011053494 | A | 3/2011 |
| JP | 2013109237 | A | 6/2013 |
| JP | 2014026273 | A | 2/2014 |
| JP | 2014026274 | A | 2/2014 |
| JP | 2014026276 | A | 2/2014 |
| JP | 2014035506 | A | 2/2014 |
| JP | 2015045848 | A | 3/2015 |
| JP | 2015045850 | A | 3/2015 |
| JP | 2015135485 | A | 7/2015 |
| JP | 2015210278 | A | 11/2015 |
| JP | 2015210279 | A | 11/2015 |
| JP | 2016045394 | A | 4/2016 |
| JP | 2016110139 | A | 6/2016 |
| JP | 2016110140 | A | 6/2016 |
| JP | 2016110150 | A | 6/2016 |
| JP | 2016114828 | A | 6/2016 |
| JP | 2016114829 | A | 6/2016 |
| JP | 2016157104 | A | 9/2016 |

OTHER PUBLICATIONS

Grant et al., Grant & Hackh's Chemical Dictionary, fifth edition, McGraw-Hill Book Company, NY (1987), pp. 124 and 283.*
Japanese Patent Office J-PlatPat machine-assisted English-translation of JP 2011-053494 (pub. Mar. 2011).*
Japanese Patent Office J-PlatPat machine-assisted English-translation of JP 2013-109237 (pub. Jun. 2013).*
Notice of Reasons for Rejection dated Jul. 25, 2017 from corresponding Japanese Patent Application No. JP 2015-084151 and English translation.

* cited by examiner

*Primary Examiner* — Janis L Dote
(74) *Attorney, Agent, or Firm* — Lucas & Mercanti, LLP

(57) ABSTRACT

A toner for developing an electrostatic latent image, the toner includes, a toner parent particle containing a binder resin, the binder resin including a crystalline resin and a hybrid resin, the hybrid resin having a main chain and a side chain, either one of or both of the main chain and the side chain including a unit derived from a crystal nucleating agent, and the crystal nucleating agent being one or more compounds selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid.

13 Claims, 1 Drawing Sheet

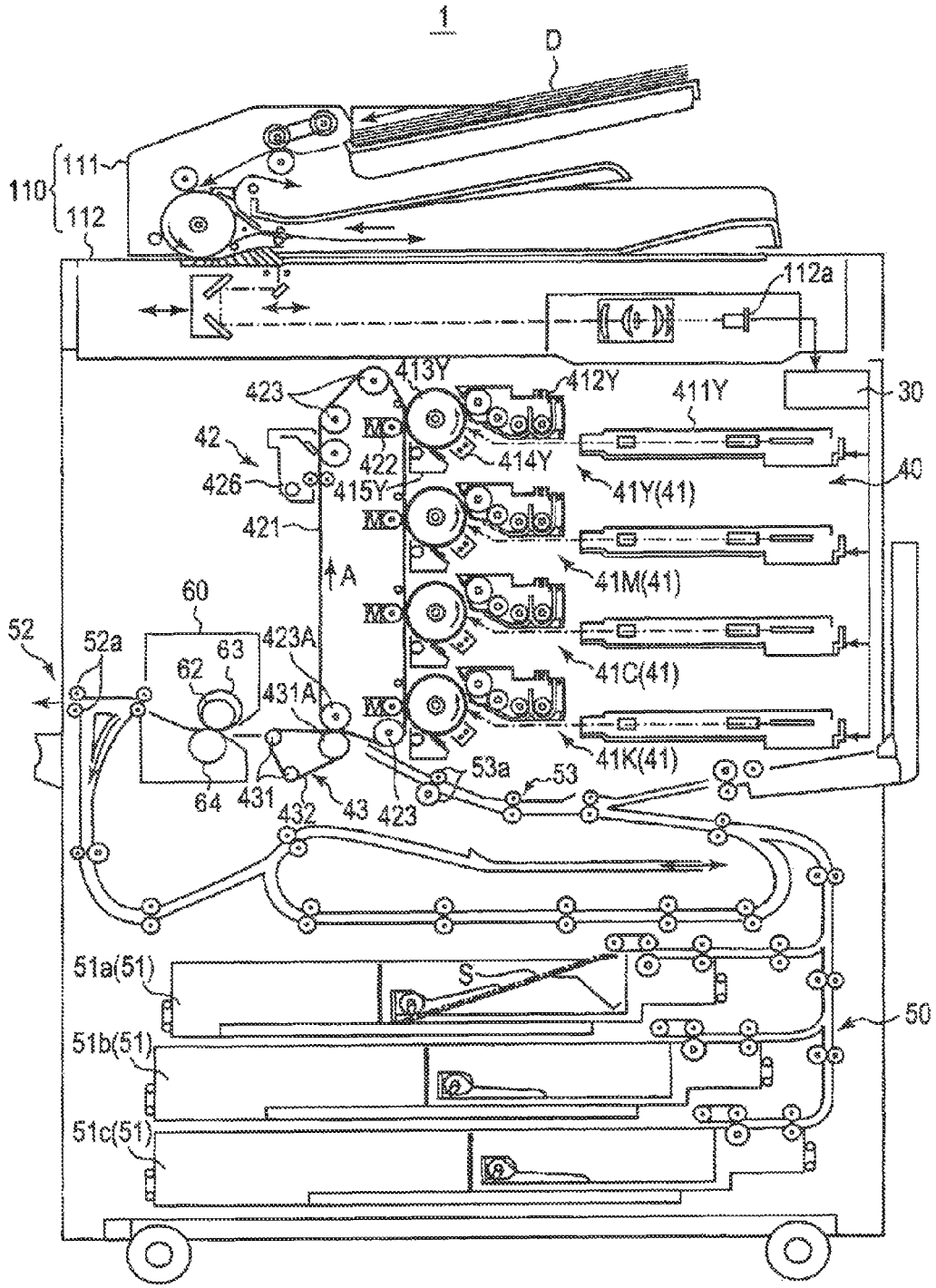
1
D
110
111
112
112a
30
40
423
413Y
412Y
411Y
42
422
414Y
426
415Y
41Y(41)
421
41M(41)
A
60
52
52a
63
62
423A
41C(41)
431A
41K(41)
53a
53
64
431
432
43
423
51a(51)
S
50
51b(51)
51c(51)

TONER AND PRODUCING METHOD THEREFOR

The entire disclosure of Japanese Patent Application No. 2015-084151 filed on Apr. 16, 2015 including description, claims, drawings, and abstract are incorporated herein by reference in its entirety.

BACKGROUND OF THE INVENTION

Field of the Invention

The present invention relates to a toner for developing an electrostatic latent image and a producing method therefor.

Description of the Related Art

In an electrophotographic image forming method, for example, a two-component developer (toner), which contains a toner particle containing a colorant and a carrier particle for stirring and conveying the toner particle, is used. In the image forming method, for the purpose of increasing the speed of image formation, reducing a load to the environment, or the like, there is a demand for decreasing heat energy in fixing. For this reason, the toner particle needs to have low-temperature fixability. In this regard, it is generally known to blend a crystalline resin, such as crystalline polyester, having an excellent sharp melting property with a binder resin.

For example, in a binder resin containing a crystalline polyester resin and an amorphous resin, when a temperature of the binder resin exceeds a melting point of the crystalline polyester due to, for example, heating in fixing, the crystalline part of the crystalline polyester resin in the binder resin is melted. As a result, the crystalline polyester resin and the amorphous resin are compatible each other, and thus the low-temperature fixation of the toner particle is realized. However, in the toner particle, compatibilization of both the resins is caused at a reaction temperature in producing of the toner particle, and thus the toner particle becomes soft. As a result, the storage stability of the toner may not be sufficient.

As a countermeasure for suppressing the compatibilization in producing of the toner particle described above, a binder resin containing a resin into which a crystal nucleating agent having a melting point higher than a melting point of a binder resin is introduced, is known. In the binder resin, for example, there is known a resin in which a crystalline polyester resin, an amorphous polyester resin, and a vinyl-based resin component are bonded to a polyolefin resin component, the resin having a crystal nucleating agent part at the terminal of the crystalline polyester resin. The crystal nucleating agent part is a part derived from at least one compound selected from the group consisting of aliphatic carboxylic acid having 10 to 30 carbon atoms and aliphatic alcohol having 10 to 30 carbon atoms (for example, see JP 2014-26273 A).

Further, in the binder resin, for example, there is known a resin containing a crystalline polyester resin and an amorphous polyester resin, the resin having the crystal nucleating agent part at the terminal of the crystalline polyester resin (for example, see JP 2014-26274 A and JP 2014-26276 A).

In the aforementioned binder resin of the related art, the crystallization of the crystalline resin component in the binder resin is promoted by introduction of a crystal nucleating agent. However, in the binder resin, the introduced crystal nucleating agent is difficult to uniformly disperse in the inside of a toner parent particle, and thus may be eccentrically located on the surface of the toner parent particle or in the vicinity thereof. For this reason, the binder resin may be melted on the surface of the toner parent particle or in the vicinity thereof due to heat from the outside at the time of production or storage. As a result, the storage stability of the toner may not be sufficient. In addition, since some components in the binder resin are eccentrically located on the surface of the toner parent particle or in the vicinity thereof, the charging uniformity of the toner particle may not be sufficient.

SUMMARY OF THE INVENTION

An object of the present invention is to provide a toner that is excellent in low-temperature fixability, high-temperature storage stability, and charging uniformity.

To achieve the abovementioned object, according to an aspect, a toner for developing an electrostatic latent image, the toner reflecting one aspect of the present invention comprises a toner parent particle containing a binder resin, the binder resin including a crystalline resin and a hybrid resin, the hybrid resin having a main chain and a side chain, either one of or both of the main chain and the side chain including a unit derived from a crystal nucleating agent, and the crystal nucleating agent being one or more compounds selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid.

To achieve the abovementioned object, according to an aspect, a toner for developing an electrostatic latent image, the toner reflecting one aspect of the present invention comprises a toner parent particle containing a binder resin, the binder resin including a hybrid crystalline resin, the hybrid crystalline resin having a main chain, a first side chain bonded to the main chain, and a second side chain bonded to the main chain other than the first side chain, the first side chain including a crystalline resin unit, either one of or both of the main chain and the second side chain including a unit derived from a crystal nucleating agent, and the crystal nucleating agent being one or more compounds selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid.

To achieve the abovementioned object, according to an aspect, a method for producing a toner for developing an electrostatic latent image, the toner that includes a toner parent particle containing a binder resin including a crystalline resin and a hybrid resin, the method reflecting one aspect of the present invention comprises: dispersing fine particles of the crystalline resin and fine particles of the hybrid resin in an aqueous medium; and aggregating and fusing at least the fine particles of the crystalline resin and the fine particles of the hybrid resin in the aqueous medium to form the toner parent particle.

BRIEF DESCRIPTION OF THE DRAWING-A

The above and other objects, advantages and features of the present invention will become more fully understood from the detailed description given hereinbelow and the appended drawing which are given by way of illustration only, and thus are not intended as a definition of the limits of the present invention, and wherein:

The FIGURE is a diagram schematically illustrating an exemplary configuration of an image forming apparatus in which a toner according to an embodiment of the present invention is used.

DESCRIPTION OF THE PREFERRED EMBODIMENTS

Hereinafter, an embodiment of the present invention will be described with reference to the drawings. However, the scope of the invention is not limited to the illustrated examples.

Both of a first toner and a second toner according to the present invention are a toner for developing an electrostatic latent image, the toner including a toner parent particle containing a binder resin. The binder resin of the first toner includes a crystalline resin and a hybrid resin. The binder resin of the second toner includes a hybrid crystalline resin. The first toner and the second toner can be configured in the same way, except that a different binder resin is used. Hereinbelow, the binder resin of the first toner is referred to as a first binder resin, and the binder resin of the second toner is referred to as a second binder resin. The toner according to the present invention will be described in the order of these binder resins and the configuration common to both the toners.

As described above, the first binder resin includes a crystalline resin and a hybrid resin. The crystalline resin has crystallinity. The crystalline resin indicates a resin that does not have a stepwise endothermic change but has a clear endothermic peak in differential scanning calorimetry (DSC). Specifically, the clear endothermic peak means a peak in which a full width at half maximum of an endothermic peak is within 15° C. when observation is conducted at a temperature increasing rate of 10° C./min in the DSC. Incidentally, as the full width at half maximum is smaller, the degree of crystallinity is higher. One or more kinds of the crystalline resin may be used. A melting point of the crystalline resin is preferably 55 to 80° C. from the viewpoint of sufficiently softening the toner to secure sufficient low-temperature fixability, and is more preferably 75 to 85° C. from the viewpoint of further improving various characteristics with good balance.

The crystalline resin is preferably a crystalline polyester resin from the viewpoint of easily adjusting the melting point. The melting point of the crystalline polyester resin can be controlled by a resin composition (for example, the type of a monomer). The crystalline polyester can be synthesized by a well-known method using a dehydration condensation reaction of polycarboxylic acid and polyhydric alcohol.

Examples of the polycarboxylic acid include saturated aliphatic dicarboxylic acid such as succinic acid, sebacic acid, or dodecanedioic acid; alicyclic dicarboxylic acid such as cyclohexane dicarboxylic acid; aromatic dicarboxylic acid such as phthalic acid, isophthalic acid, or terephthalic acid; trivalent or higher polycarboxylic acid such as trimellitic acid or pyromellitic acid; acid anhydrides thereof; and alkyl esters thereof having 1 to 3 carbon atoms. The polycarboxylic acid is preferably aliphatic dicarboxylic acid.

Examples of the polyhydric alcohol include aliphatic diol such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, or 1,4-butenediol; and trivalent or higher alcohol such as glycerin, pentaerythritol, trimethylolpropane, or sorbitol. The polyhydric alcohol is preferably aliphatic diol.

The hybrid resin has a main chain and a side chain, and at least any one of a unit configuring the main chain and a unit configuring the side chain includes a unit derived from a crystal nucleating agent (a crystal nucleating agent part). Regarding both of the main chain and the side chain, one or more kinds thereof may be used. The term "a unit configuring the main chain" means a part or the whole of a structural unit configuring the main chain, and the term "a unit configuring the side chain" means a part or the whole of a structural unit configuring the side chain. The term "a unit derived from a crystal nucleating agent" means a part in which a crystal nucleating agent is introduced into the main chain or the side chain by a chemical bond.

One or more kinds of the hybrid resin may be used. As for the hybrid resin, for example, the main chain thereof may include the crystal nucleating agent part, the side chain thereof may include the crystal nucleating agent part, or both of the main chain and the side chain may include the crystal nucleating agent part. Further, the side chain may be configured by only the crystal nucleating agent part. The crystal nucleating agent part configures a part of the main chain or the side chain, for example, by a chemical bond such as an ester bond.

From the viewpoint of introducing the crystal nucleating agent part into the inside of the toner parent particle, the side chain preferably includes the crystal nucleating agent bonded to the main chain, that is, includes only the crystal nucleating agent.

Examples of the crystal nucleating agent include arachidyl alcohol, behenyl alcohol, 1-tetracosanol, 1-hexacosanol, octacosanol, palmitic acid, margaric acid, stearic acid, arachidic acid, behenic acid, and lignoceric acid. One or more kinds of the crystal nucleating agent may be also used.

Further, the melting point of the crystal nucleating agent is preferably higher than the melting point of the crystalline resin. The reason for this is considered as follows. In the first toner, when the crystalline resin, which undergoes compatibilization with the amorphous resin by heating in producing of the first toner, is cooled, first, crystallization of the crystal nucleating agent part is carried out, and uniform crystalline nuclei are generated. The crystalline resin is arranged in these crystalline nuclei in a folded manner, and crystals thereof are grown. For this reason, fine and uniform crystals are formed rapidly. Therefore, it is considered that the crystallization is sufficiently carried out so that storage stability at high temperature is improved, and crystals are sufficiently fine so that sufficient low-temperature fixability is obtained. For example, a melting point MP1 of the crystal nucleating agent is higher than a melting point MP2 of the crystalline resin preferably by 2 to 25° C., and more preferably by 4 to 15° C., from the above viewpoint.

When the crystal nucleating agent part is included in the main chain or the side chain, the hybrid resin is substantially configured, but units other than the crystal nucleating agent part may be further included in the range in which the effect of this embodiment is exhibited. Examples of the other units include an amorphous resin unit. The amorphous resin unit is a structural unit, which is included in a resin chain constituting the main chain or the side chain, derived from the amorphous resin to be described later, and one or more kinds thereof may be used. The amorphous resin unit may be included in, for example, the main chain, or may be included in a side chain other than the side chain described above. Examples of the amorphous resin unit include a vinyl-based resin unit. The vinyl-based resin unit is a structural unit, which is included in a resin chain constituting the main chain or the side chain, derived from a vinyl-based resin to be described later.

When the content of the crystal nucleating agent part in the hybrid resin is too small, the effect obtained by the crystal nucleating agent part may not be sufficient. When the content thereof is too large, it is difficult to introduce the crystalline resin into the inside of the toner parent particle, and thus the crystalline resin is easily exposed from the surface of the toner parent particle. As a result, the electrostatic-charging property or the high-temperature storage stability of the first toner may be deteriorated. The content thereof is preferably 0.1 to 10% by mass, and more preferably 1 to 8% by mass, from the viewpoint of sufficiently dispersing the crystal nucleating agent part in the inside of the toner parent particle.

Further, when the content of the amorphous resin unit in the hybrid resin is too small, the effect of improving affinity in the binder resin due to the amorphous resin unit may not be sufficient. When the content thereof is too large, the low-temperature fixability may not be sufficient. The content thereof is preferably 80 to 99.9% by mass, and more preferably 90 to 99.5% by mass, from the viewpoint of sufficiently dispersing the crystal nucleating agent part in the inside of the toner parent particle.

Further, when the crystalline resin and the hybrid resin are included, the first binder resin is substantially configured, but a resin other than the crystalline resin and the hybrid resin may be further included in the range in which the effect of this embodiment is exhibited. Examples of the other resin include an amorphous resin.

One or more kinds of the amorphous resin may be used. The amorphous resin does not substantially have crystallinity, but for example, an amorphous part is included in the resin. Examples of the amorphous resin include a vinyl-based resin, an amorphous polyester resin, and a partially modified polyester resin.

The vinyl-based resin is a resin obtained by polymerization of a compound having a vinyl group or a monomer containing a derivative thereof, and one or more kinds of the vinyl-based resin may be used. Examples of the vinyl-based resin include a styrene-(meth)acrylic resin.

The styrene-(meth)acrylic resin has a molecular structure of a radical polymer of a compound having a radical polymerizable unsaturated bond, and can be synthesized, for example, by radical polymerization of the compound. One or more kinds of the compound may be used, and examples thereof include styrene and a derivative thereof, and (meth) acrylic acid and a derivative thereof.

Examples of the styrene and a derivative thereof include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the (meth)acrylic acid and a derivative thereof include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-propyl aminoacrylate, stearyl methacrylate, dimethylaminoethyl methacrylate, and diethylaminoethyl methacrylate.

When the content of the crystalline resin in the first binder resin is too small, the low-temperature fixability of the first toner may not be sufficient. When the content thereof is too large, the crystalline resin is easily exposed from the surface of the toner parent particle, and thus the high-temperature storage stability and the electrostatic-charging property of the first toner may not be sufficient. The content thereof is preferably 1 to 30% by mass, and more preferably 5 to 20% by mass, from the viewpoint of more reliably exhibiting any of low-temperature fixability, high-temperature storage stability, and electrostatic-charging property.

When the content of the hybrid resin in the first binder resin is too small, the low-temperature fixability and the high-temperature storage stability of the first toner may not be sufficient. When the content thereof is too large, the low-temperature fixability of the first toner may be inhibited due to the high melting point thereof. The content thereof is preferably 1 to 30% by mass, and more preferably 5 to 20% by mass, from the viewpoint of more reliably achieving promoting of the crystallization of the crystalline resin and exhibiting of the low-temperature fixability of the first toner, and the viewpoint of exhibiting various characteristics with good balance.

Further, when the content of the amorphous resin in the first binder resin is too small, the crystalline resin is easily exposed from the surface of the toner parent particle, and thus the high-temperature storage stability and the electrostatic-charging property of the first toner may not be sufficient. When the content thereof is too large, the amount of the crystalline resin or the crystal nucleating agent part relatively decreases, and thus the low-temperature fixability of the first toner may not be sufficient. The content thereof is preferably 50 to 90% by mass, and more preferably 60 to 85% by mass, from the viewpoint of more reliably exhibiting the low-temperature fixability, the high-temperature storage stability, and the electrostatic-charging property.

As described above, the second binder resin includes a hybrid crystalline resin. The hybrid crystalline resin has a main chain, a first side chain bonded to the main chain, and a second side chain bonded to the main chain other than the first side chain. Regarding all of the main chain, the first side chain, and the second side chain, one or more kinds thereof may be used.

The main chain preferably includes the amorphous resin unit, from the viewpoint of the fact that the crystalline resin unit included in the first side chain and the crystal nucleating agent part included in the second side chain are sufficiently arranged and dispersed in the inside of the toner parent particle. Further, the amorphous resin unit is preferably a vinyl-based resin unit, from the above viewpoint.

The first side chain includes a crystalline resin unit. The crystalline resin unit is a structural unit, which is included in a resin chain constituting the first side chain, derived from the crystalline resin. When the crystalline resin unit is included, the first side chain is substantially configured, but a unit other than the crystalline resin unit may be further included in the range in which the effect of this embodiment is exhibited. Examples of the other unit include an amorphous resin unit.

The second side chain is a side chain different from the first side chain, that is, a side chain which does not include the crystalline resin unit. Further, either one of or both of the main chain and the second side chain include a unit derived from a crystal nucleating agent (the crystal nucleating agent part described above). It is preferable that one of the main chain and the second side chain include the crystal nucleating agent part and the other thereof include the amorphous resin unit, from the viewpoint of suppressing the crystal nucleating agent part from being exposed from the surface of the toner parent particle. It is more preferable that the main chain include the amorphous resin unit and the second side chain include the crystal nucleating agent part, from the above viewpoint.

When the first side chain includes the crystalline resin unit and at least one of the main chain and the second side chain includes the crystal nucleating agent part, the hybrid crystalline resin is substantially configured, but the second side chain may include a unit other than the crystal nucleating agent part in the range in which the effect of this embodiment is exhibited. It is also more preferable that the second side chain include the crystal nucleating agent bonded to the main chain (include only the crystal nucleating agent part), from the above viewpoint.

For example, the melting point MP1 of the crystal nucleating agent is higher than the melting point MP2 of the crystalline resin preferably by 2 to 25° C., and more preferably by 4 to 15° C., from the above viewpoint.

The melting point of the crystal nucleating agent is preferably higher than the melting point of the hybrid crystalline resin. The reason for this is considered as follows. In the second toner, when the crystalline resin, which undergoes compatibilization with the amorphous resin by heating in producing of the second toner, is cooled, first, crystallization of the crystal nucleating agent part is carried out, and uniform crystalline nuclei are generated. The crystalline resin unit of the hybrid crystalline resin is arranged in these crystalline nuclei in a folded manner, and crystals thereof are grown. For this reason, fine and uniform crystals are formed rapidly. Therefore, it is considered that the crystallization is sufficiently carried out so that high-temperature storage stability is improved, and crystals are sufficiently fine so that sufficient low-temperature fixability is obtained. For example, the melting point MP1 of the crystal nucleating agent is higher than a melting point MP3 of the hybrid crystalline resin preferably by 2 to 25° C., and more preferably by 4 to 15° C., from the above viewpoint.

When the content of the crystalline resin unit in the hybrid crystalline resin is too small, the low-temperature fixability of the second toner may not be sufficient. When the content thereof is too large, the crystalline resin is easily exposed from the surface of the toner parent particle, and thus the high-temperature storage stability and the electrostatic-charging property may not be sufficient. The content thereof is preferably 70 to 95% by mass, and more preferably 75 to 85% by mass, from the viewpoint of more reliably exhibiting low-temperature fixability, high-temperature storage stability, and electrostatic-charging property.

When the content of the crystal nucleating agent part in the hybrid crystalline resin is too small, the low-temperature fixability and the high-temperature storage stability of the second toner may not be sufficient. When the content thereof is too large, it is difficult to introduce the crystalline resin unit into the inside of the toner parent particle, and thus the crystalline resin unit is easily exposed from the surface of the parent particle. Therefore, the electrostatic-charging property and the high-temperature storage stability may be deteriorated. The content thereof is preferably 0.1 to 10% by mass, and more preferably 1 to 8% by mass, from the viewpoint of sufficiently dispersing the crystal nucleating agent part in the inside of the toner parent particle.

Further, similarly to the first binder resin, when the hybrid crystalline resin is included, the second binder resin is substantially configured, but a resin other than the hybrid crystalline resin may be further included in the range in which the effect of this embodiment is exhibited. Examples of the other resin include the amorphous resin.

The content of the hybrid crystalline resin in the second binder resin is preferably 1 to 30% by mass, and more preferably 5 to 20% by mass, from the viewpoint of more reliably exhibiting the low-temperature fixability, the high-temperature storage stability, and the electrostatic-charging property with good balance in the second toner.

Further, the content of the amorphous resin in the second binder resin is preferably 50 to 99% by mass, and more preferably 60 to 90% by mass, from the viewpoint of more reliably exhibiting the low-temperature fixability, the high-temperature storage stability, and the electrostatic-charging property in the second toner.

The content of each resin or each unit described above in the first binder resin or the second binder resin may be specified or estimated by using a well-known instrumental analysis such as nuclear magnetic resonance (NMR) or pyrolysis of methylation reaction-gas chromatography/mass spectrometry (P-GC/MS).

Further, regarding the main chain in the first binder resin or the second binder resin, it is preferable that a resin unit that becomes the side chain or a part derived from a dually reactive monomer for chemically bonding the crystal nucleating agent to the main chain be further included in the main chain. The dually reactive monomer has both of a resin unit included in the main chain or a first functional group for connecting the resin unit and a resin unit included in the side chain or a second functional group for chemically bonding a crystal nucleating agent.

For example, when the main chain includes a vinyl-based resin unit and the side chain includes a polyester unit, the dually reactive monomer has a radical polymerizable unsaturated bond and a hydroxyl group or an acidic group, such as a carboxyl group, for dehydration and condensation with the polycarboxylic acid or polyhydric alcohol. Further, for example, when the main chain includes a vinyl-based resin unit and the side chain includes only a crystal nucleating agent part, the dually reactive monomer has a radical polymerizable unsaturated bond and a carboxyl group or hydroxyl group for dehydration and condensation with a hydroxyl group or a carboxyl group. Examples of the dually reactive monomer include (meth)acrylic acid, fumaric acid, maleic acid, and maleic anhydride. The content of the dually reactive monomer in the monomer constituting the main chain is preferably 0.5 to 20% by mass, more preferably 1 to 15% by mass, and further preferably 2 to 10% by mass, from the viewpoint of introducing a sufficient amount of the side chain into the main chain.

In the synthesis of the resin unit in the first and second binder resins, a chain transfer agent for adjusting a molecular weight of a resin to be obtained may be further included in a raw material of a monomer or the like of the resin unit. One or more kinds of the chain transfer agent may be used, and the chain transfer agent is used in such an amount that the above-described object can be achieved, in the range in which the effect of this embodiment is exhibited. Examples of the chain transfer agent include 2-chloroethanol, mercaptan such as octylmercaptan, dodecylmercaptan, or t-dodecylmercaptan, and a styrene dimer.

The first binder resin or the second binder resin can be produced according to a synthesis method of a general graft copolymer. For example, the first binder resin or the second binder resin can be produced by a method including a step of polymerizing a monomer for constituting the resin unit in the main chain and the dually reactive monomer, and a step of polymerizing or reacting either one of or both of a monomer for constituting the resin unit in the side chain and the crystal nucleating agent in the presence of the obtained main chain precursor. The structures and amounts of the main chain and the side chain in the obtained resin can be determined or estimated by using, for example, a well-known instrumental analysis, such as NMR or electrospray ionization mass spectrometry (ESI-MS), on the binder resin or a hydrolysate thereof.

The first toner has a toner parent particle (a first toner parent particle) containing the first binder resin, and the second toner has a toner parent particle (a second toner parent particle) containing the second binder resin. Both of the first and second toner parent particles may further contain a component other than a binder resin in the range in which the effect of this embodiment is exhibited. Examples of the other component include a colorant, a mold-releasing agent, and an electrostatic-charging control agent. One or more kinds of the other component may be used.

One or more kinds of the colorant may be used. As the colorant, a well-known inorganic or organic colorant used for a colorant of a color toner is used. Examples of the colorant include carbon black, a magnetic material, a pigment, and a dye.

Examples of the carbon black include channel black, furnace black, acetylene black, thermal black, and lamp black. Examples of the magnetic material include ferromagnetic metal such as iron, nickel, or cobalt, an alloy containing these metals, and a compound of ferromagnetic metal such as ferrite or magnetite.

Examples of the pigment include C.I. Pigment Red 2, C.I. Pigment Red 3, C.I. Pigment Red 5, C.I. Pigment Red 7, C.I. Pigment Red 15, C.I. Pigment Red 16, C.I. Pigment Red 48:1, C.I. Pigment Red 48:3, C.I. Pigment Red 53:1, C.I. Pigment Red 57:1, C.I. Pigment Red 81:4, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 208, C.I. Pigment Red 209, C.I. Pigment Red 222, C.I. Pigment Red 238, C.I. Pigment Red 269, C.I. Pigment Orange 31, C.I. Pigment Orange 43, C.I. Pigment Yellow 3, C.I. Pigment Yellow 9, C.I. Pigment Yellow 14, C.I. Pigment Yellow 17, C.I. Pigment Yellow 35, C.I. Pigment Yellow 36, C.I. Pigment Yellow 65, C.I. Pigment Yellow 74, C.I. Pigment Yellow 83, C.I. Pigment Yellow 93, C.I. Pigment Yellow 94, C.I. Pigment Yellow 98, C.I. Pigment Yellow 110, C.I. Pigment Yellow 111, C.I. Pigment Yellow 138, C.I. Pigment Yellow 139, C.I. Pigment Yellow 153, C.I. Pigment Yellow 155, C.I. Pigment Yellow 180, C.I. Pigment Yellow 181, C.I. Pigment Yellow 185, C.I. Pigment Green 7, C.I. Pigment Blue 15:3, C.I. Pigment Blue 15:4, C.I. Pigment Blue 60, and a phthalocyanine pigment having zinc, titanium, or magnesium as a central metal.

Examples of the dye include C.I. Solvent Red 1, C.I. Solvent Red 3, C.I. Solvent Red 14, C.I. Solvent Red 17, C.I. Solvent Red 18, C.I. Solvent Red 22, C.I. Solvent Red 23, C.I. Solvent Red 49, C.I. Solvent Red 51, C.I. Solvent Red 52, C.I. Solvent Red 58, C.I. Solvent Red 63, C.I. Solvent Red 87, C.I. Solvent Red 111, C.I. Solvent Red 122, C.I. Solvent Red 127, C.I. Solvent Red 128, C.I. Solvent Red 131, C.I. Solvent Red 145, C.I. Solvent Red 146, C.I. Solvent Red 149, C.I. Solvent Red 150, C.I. Solvent Red 151, C.I. Solvent Red 152, C.I. Solvent Red 153, C.I. Solvent Red 154, C.I. Solvent Red 155, C.I. Solvent Red 156, C.I. Solvent Red 157, C.I. Solvent Red 158, C.I. Solvent Red 176, C.I. Solvent Red 179, pyrazolotriazole dyes, pyrazolotriazole azomethine dyes, pyrazolone azo dyes, pyrazolone azomethine dyes, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I . Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, and C.I. Solvent Blue 95.

Examples of the mold-releasing agent (wax) include hydrocarbon wax and ester wax. Examples of the hydrocarbon wax include low-molecular-weight polyethylene wax, low-molecular-weight polypropylene wax, Fischer-Tropsch wax, microcrystalline wax, and paraffin wax. Further, examples of the ester wax include carnauba wax, pentaerythritol behenic acid ester, behenyl behenate, and behenyl citrate.

Examples of the electrostatic-charging control agent include a nigrosine-based dye, a metal salt of naphthenic acid or higher fatty acid, an alkoxylated amine, a quaternary ammonium salt compound, an azo-type metal complex, and a salicylic acid metal salt or a metal complex thereof.

From the viewpoint of appropriately controlling the particle diameter and the circularity degree of the toner parent particle. The toner parent particle is preferably a polymerized toner prepared in an aqueous medium as compared to a pulverized toner, and is more preferably a toner parent particle obtained by an emulsion polymerization and coagulation method.

The toner particle has, for example, the toner parent particle and an external additive present on the surface of the toner parent particle. The toner particle preferably contains an external additive from the viewpoint of controlling the flowability, the electrostatic-charging property, and the like of the toner particle. One or more kinds of the external additive may be used. Examples of the external additive include silica particles, titania particles, alumina particles, zirconia particles, zinc oxide particles, chromic oxide particles, cerium oxide particles, antimony oxide particles, tungsten oxide particles, tin oxide particles, tellurium oxide particles, manganese oxide particles, and boron oxide particles.

The external additive more preferably includes silica particles prepared by a sol-gel method. Since the silica particles prepared by a sol-gel method have characteristics in which the particle size distribution is narrow, the silica particles are preferable from the viewpoint of suppressing a variation in attached strength of the external additive with respect to the toner parent particle.

Further, the number-average primary particle size of the silica particles is preferably 70 to 200 nm. The silica particles having a number-average primary particle size within the above range are larger than another external additive. Therefore, the silica particles function as spacers in a two-component developer. Accordingly, when the two-component developer is stirred in a developing device, from the viewpoint of preventing another external additive having a smaller particle diameter from being embedded in a toner parent particle, the silica particles having a number-average primary particle size within the above range are preferable. Further, from the viewpoint of preventing the fusion between the toner parent particles, the silica particles having a number-average primary particle size within the above range are also preferable.

The number-average primary particle size of the external additive can be obtained, for example, by image processing an image captured by a transmission electron microscope and can be adjusted, for example, by classification or the mixing of classified products.

The surface of the external additive is preferably subjected to a hydrophobilization treatment. In the hydrophobilization treatment, a well-known surface treatment agent is used. One or more kinds of the surface treatment agent may be used. Examples thereof include a silane coupling agent, silicone oil, a titanate coupling agent, an aluminate coupling agent, a fatty acid, a metal salt of fatty acid, an esterified substance thereof, and rosin acid.

Examples of the silane coupling agent include dimethyldimethoxysilane, hexamethyldisilazane (HMDS), methyltrimethoxysilane, isobutyltrimethoxysilane, and decyltrimethoxysilane. Examples of the silicone oil include a cyclic compound, and a linear or branched organosiloxane, and specific examples thereof include an organosiloxane oligomer, octamethylcyclotetrasiloxane, decamethylcyclopentasiloxane, tetramethylcyclotetrasiloxane, and tetravinyltetramethylcyclotetrasiloxane.

Further, examples of the silicone oil include silicone oil with high reactivity, in which a modification group is introduced in a side chain or one or both terminals, one terminal of a side chain, both terminals of a side chain, or the like, and at least a terminal is modified. One or more kinds of the modification group may be used. Examples thereof include alkoxy, carboxyl, carbinol, higher fatty acid-modified, phenol, epoxy, methacryl, and amino.

The added amount of the external additive is preferably 0.1 to 10.0% by mass with respect to the entire toner particles. More preferably, the added amount thereof is 1.0 to 3.0% by mass.

In the case of a single-component developer, the toner is configured by the toner particle itself. In the case of a two-component developer, the toner is configured by the toner particle and a carrier particle. The content of the toner particle (toner concentration) in the two-component developer may be the same as in a general two-component developer, and, for example, is 4.0 to 8.0% by mass.

The carrier particle is configured by a magnetic material. Examples of the carrier particle include a coating type carrier particle having a core particle formed by the magnetic material and a layer of a coating material coating the surface of the core particle and a resin dispersion type carrier particle in which fine powder of the magnetic material is dispersed in a resin. The carrier particle is preferably a coating type carrier particle from the viewpoint of suppressing the adhesion of the carrier particle to a photoconductor.

The core particle is configured by the magnetic material, for example, a material magnetizing strongly by a magnetic field in the direction thereof. One or more kinds of the magnetic material may be used, and examples thereof include metals exhibiting a ferromagnetic property, such as iron, nickel, and cobalt, an alloy or a compound containing these metals, and an alloy exhibiting a ferromagnetic property through a heat treatment.

Examples of the metals exhibiting a ferromagnetic property or the compound containing these metals include iron, ferrite represented by the following Formula (a), and magnetite represented by the following Formula (b). M in Formula (a) and Formula (b) represents one or more monovalent or divalent metals selected from the group consisting of Mn, Fe, Ni, Co, Cu, Mg, Zn, Cd, and Li.

$$MO.Fe_2O_3 \qquad \text{Formula (a)}$$

$$MFe_2O_4 \qquad \text{Formula (b)}$$

Further, examples of the alloy exhibiting a ferromagnetic property through a heat treatment include a Heusler alloy such as manganese-copper-aluminum or manganese-copper-tin, and chromium dioxide.

The core particle is preferably various kinds of ferrite. The reason for this is that the specific gravity of the coating type carrier particle is smaller than the specific gravity of the metal constituting the core particle, and thus the impulsive force of stirring in a developing device can be further decreased.

One or more kinds of the coating material may be used. A well-known resin which is used for coating the core particle of the carrier particle can be used as the coating material. The coating material is preferably a resin having a cycloalkyl group from the viewpoint of decreasing the moisture adsorptive property of the carrier particle and the viewpoint of enhancing adhesion of the coating layer with the core particle. Examples of the cycloalkyl group include a cyclohexyl group, a cyclopentyl group, a cyclopropyl group, a cyclobutyl group, a cycloheptyl group, a cyclooctyl group, a cyclononyl group, and a cyclodecyl group. Among them, a cyclohexyl group or a cyclopentyl group is preferable, and from the viewpoint of adhesion between the coating layer and the ferrite particle, a cyclohexyl group is more preferable.

The weight average molecular weight Mw of the resin having the cycloalkyl group is, for example, 10,000 to 800,000, and more preferably 100,000 to 750,000. The content of the cycloalkyl group in the resin is, for example, 10% by mass to 90% by mass. The content of the cycloalkyl group in the resin can be obtained by using, for example, a well-known instrumental analysis such as P-GC/MS or $^1$H-NMR.

The two-component developer can be produced by mixing the toner particle and the carrier particle in an appropriate amount. Examples of a mixing device used in the mixing include a NAUTA mixer, and W-cone and V-type mixers.

The size and the shape of the toner particle may be appropriately decided in the range in which the effect of this embodiment can be obtained. For example, the volume average particle diameter of the toner particle is 3.0 to 8.0 μm, and the average circularity of the toner particle is 0.920 to 1.000.

The number average particle diameter of the toner particle can be measured and calculated by using an apparatus in which a computer system for data processing is connected to "MULTISIZE 3" (manufactured by Beckman Coulter, Inc.). Further, the number average particle diameter of the toner particle can be adjusted, for example, by temperature and stirring conditions in producing of the toner particle, classification of the toner particles, or the mixing of classified products of the toner particles.

The average circularity of the toner particle is obtained, for example, by using a flow type particle image analyzer "FPIA-3000" (manufactured by Sysmex Corporation) in such a manner that the sum of circularity degrees C., which are calculated by the following equation from a circumferential length L1 of a circle having the same projected area as a particle image and a circumferential length L2 of a projected particle image, in a predetermined number of toner particles is divided by the predetermined number. The average circularity of the toner particle can be adjusted, for example, by the degree of aging of the resin particle in producing of the toner particle, a heat treatment of the toner particle, or the mixing of toner particles each having a different circularity degree.

$$C=L1/L2 \qquad \text{(Equation)}$$

Further, the size and the shape of the carrier particle can also be appropriately determined in the range in which the effect of this embodiment can be obtained. For example, the volume average particle diameter of the carrier particle is 15 to 100 μm. The volume average particle diameter of the carrier particle can be measured, for example, by a laser diffraction particle size distribution measuring apparatus "HELOS KA" (manufactured by Japan Laser Corporation) in a wet method. Further, the volume average particle diameter of the carrier particle can be adjusted, for example, by a method of controlling the particle diameter of the core particle using production conditions of the core particle, classification of the core particle, or the mixing of classified products of the carrier particle.

The first toner and the second toner can be produced by the same producing method except the step of producing a toner parent particle.

The first toner can be produced, for example, by a method including: a step of dispersing fine particles of the crystalline resin and fine particles of the hybrid resin in an aqueous medium; and a step of aggregating and fusing at least the fine particles of the crystalline resin and the fine particles of the hybrid resin in the aqueous medium to form the first toner parent particle.

The second toner can be produced, for example, by a method including: a step of dispersing fine particles of the hybrid crystalline resin in an aqueous medium; and a step of aggregating and fusing at least the fine particles of the hybrid crystalline resin in the aqueous medium to form the second toner parent particle.

Both of the above-described producing methods may further include a step of dispersing, aggregating, and fusing the aforementioned other component in an appropriate form in an aqueous medium. For example, both of the above-described producing methods may further include a step of further dispersing third resin fine particle, in which another component such as a colorant is dispersed in a resin component, in the aqueous medium and a step of aggregating and fusing the third resin fine particles in the resin fine particles in the aqueous medium.

Further, both of the above-described producing methods may further include an appropriate step depending on the shape of the toner. For example, both of the above-described producing methods may further include either one of or both of a step of mixing the external additive in the toner parent particle and a step of mixing the toner particle in the carrier particle.

In the first toner, the crystal nucleating agent part and the crystalline resin are easily introduced into the inside of the toner parent particle. The reasons for this are considered as follows. The first reason is aggregation caused by affinity between crystal nucleating agent parts. The crystal nucleating agent parts in the hybrid resin have a relatively high affinity therebetween in the toner parent particle. Therefore, in the toner parent particle, the hybrid resin is disposed such that the crystal nucleating agent parts come close to each other. As a result, the crystal nucleating agent parts in the hybrid resin are relatively disposed in a center side of the toner parent particle, and a part other than the crystal nucleating agent part in the hybrid resin is relatively disposed in a surface side of the toner parent particle.

The second reason is aggregation caused by affinity between a crystalline resin and a crystal nucleating agent part. The crystal nucleating agent part has a relatively long alkyl chain. On the other hand, the crystalline resin has typically a linear alkyl chain or molecular structures which have regularity and are used for being disposed to each other, such as linear molecular structures. Both of the linear molecular structures also have a relatively high affinity with each other. For this reason, in the toner parent particle, the crystalline resin is also relatively disposed in the center side of the toner parent particle while coming close to the crystal nucleating agent.

The aforementioned tendency of the arrangement of the crystal nucleating agent and the crystalline resin in the toner parent particle is considered to be significantly exhibited in a case where the binder resin further includes an amorphous resin and the hybrid resin includes an amorphous resin unit in the main chain.

Similarly, also in the second toner, the crystal nucleating agent part and the crystalline resin unit are easily introduced into the inside of the toner parent particle. The reason for this is considered as follows. That is, in the toner parent particle, the crystal nucleating agent parts between the hybrid crystalline resins, the crystalline resin units, and the crystal nucleating agent part and the crystalline resin unit have a relatively high affinity therebetween, and thus they are disposed to come close to each other in the toner parent particle. As a result, the crystal nucleating agent parts and the crystalline resin units are likely to be relatively present in the center side of the toner parent particle.

Incidentally, the affinity is considered to be caused, for example, by similarities between the molecular structures or interaction between polar functional groups (Van der Waals' force, a hydrogen bond, or the like).

The crystal nucleating agent part is rapidly crystallized in the toner parent particle at the time of solidifying binder resin, and thus crystallization of the crystalline resin or the crystalline resin unit is promoted. The crystalline resin or the crystalline resin unit is rapidly melted at the time of melting the binder resin, and the crystal nucleating agent part is also melted. In this way, the promotion of crystallization and the sharp melting in the binder resin are realized. On the other hand, when the crystal nucleating agent part and the crystalline resin or the crystalline resin unit are present on the surface of the toner parent particle, the toner parent particle is likely to be melted from the surface thereof due to heat from the outside of the toner parent particle.

As described above, the crystal nucleating agent part and the crystalline resin or the crystalline resin unit are appropriately dispersed in the inside of the toner parent particle of the first toner and the second toner. Therefore, the crystal nucleating agent part, the crystalline resin, and the crystalline resin unit which contribute to the sharp melting are not substantially present on the surface of the toner parent particle. According to this, it is suppressed that the crystal nucleating agent part and the crystalline resin or the crystalline resin unit are melted by heat supplied when the toner parent particle is produced or stored. Thus, both of the first toner and the second toner have sufficient low-temperature fixability, high-temperature storage stability, and electrostatic-charging stability.

As clearly understood from the above description, the first toner is a toner for developing an electrostatic latent image, the toner containing a toner parent particle which contains a binder resin, the binder resin includes a crystalline resin and a hybrid resin, the hybrid resin has a main chain and a side chain, either one of or both of the main chain and the side chain include a unit derived from a crystal nucleating agent, and the crystal nucleating agent is one or more compounds selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid. Accordingly, the first toner is excellent in low-temperature fixability, high-temperature storage stability, and charging uniformity.

The fact that the side chain includes the crystal nucleating agent bonded to the main chain in the first toner is further more effective from the viewpoint of the fact that the crystal nucleating agent part of the hybrid resin is disposed and dispersed in the center side of the toner parent particle.

Further, the fact that the melting point of the crystal nucleating agent is higher than the melting point of the crystalline resin is further more effective from the viewpoint of promoting the solidification of the binder resin.

Further, the fact that the content of the hybrid resin in the binder resin is 1 to 30% by mass is further more effective from the viewpoint of enhancing charging uniformity.

Further, the fact that the hybrid resin includes a vinyl-based resin unit is further more effective from the viewpoint of the fact that the crystal nucleating agent part of the hybrid resin is disposed and dispersed in the center side of the toner parent particle.

Further, as clearly understood from the above description, the second toner is a toner for developing an electrostatic latent image, the toner containing a toner parent particle which contains a binder resin, the binder resin includes a hybrid crystalline resin, the hybrid crystalline resin has a main chain, a first side chain bonded to the main chain, and a second side chain bonded to the main chain other than the first side chain, the first side chain includes a crystalline resin unit, and either one of or both of the main chain and the second side chain include a unit derived from the crystal nucleating agent. Therefore, the second toner is also excellent in low-temperature fixability, high-temperature storage stability, and charging uniformity.

The fact that the main chain includes an amorphous resin unit and the second side chain includes the crystal nucleating agent bonded to the main chain in the second toner is further more effective from the viewpoint of the fact that the crystal nucleating agent part of the hybrid crystalline resin is disposed and dispersed in the center side of the toner parent particle.

Further, the fact that the amorphous resin unit is a vinyl-based resin unit is further more effective from the viewpoint of the fact that the crystal nucleating agent part of the hybrid crystalline resin is disposed and dispersed in the center side of the toner parent particle.

Further, the fact that the melting point of the crystal nucleating agent is higher than the melting point of the hybrid crystalline resin is furthermore effective from the viewpoint of promoting the solidification of the binder resin.

Further, the fact that the content of the hybrid crystalline resin in the binder resin is 1 to 30% by mass is furthermore effective from the viewpoint of enhancing charging uniformity.

Further, as clearly understood from the above description, in both of the first toner and the second toner, the fact that the binder resin further includes a vinyl-based resin is further more effective from the viewpoint of the fact that each of the crystal nucleating agent part and the crystalline resin of the hybrid resin and the crystal nucleating agent part of the hybrid crystalline resin is disposed and dispersed in the center side of the toner parent particle.

Further, both of the first toner and the second toner are suitable for a two-component developer which contains a toner particle having the toner parent particle and an external additive present on the surface of the toner parent particle, and a carrier particle.

Further, as clearly understood from the above description, the method for producing the first toner includes a step of dispersing fine particles of the crystalline resin and fine particles of the hybrid resin in an aqueous medium, and a step of aggregating and fusing at least the fine particles of the crystalline resin and the fine particles of the hybrid resin in the aqueous medium to form the toner parent particle. According to this, it is possible to provide the first toner which is excellent in low-temperature fixability, high-temperature storage stability, and charging uniformity.

Further, the method for producing the second toner includes a step of dispersing fine particles of the hybrid crystalline resin in an aqueous medium and a step of aggregating and fusing at least the fine particles of the hybrid crystalline resin in the aqueous medium to form the toner parent particle. According to this, it is possible to provide the second toner which is excellent in low-temperature fixability, high-temperature storage stability, and charging uniformity.

Incidentally, both of the first toner and the second toner can be applied to a general electrophotographic image forming method. For example, both toners are accommodated in an image forming apparatus illustrated in the FIGURE, and are provided for forming a toner image on a recording medium.

An image forming apparatus 1 illustrated in the FIGURE includes an image reading section 110, an image processing section 30, an image forming section 40, a sheet conveyance section 50, and a fixing device 60.

An image forming apparatus 1 illustrated in FIG. 1 includes an image reading section 110, an image processing section 30, an image forming section 40, a sheet conveyance section 50, and a fixing device 60.

The image forming section 40 includes image forming units 41Y, 41M, 41C, and 41K which form an image by using each color toner of Y (yellow), M (magenta), C (cyan), and K (black). These image forming units have the same configuration except a toner to be accommodated therein, and thus the symbol representing color may be omitted. The image forming section 40 further includes an intermediate transfer unit 42 and a secondary transfer unit 43. These transfer units correspond to a transfer device.

The image forming unit 41 includes an exposing device 411, a developing device 412, a photoconductor drum 413, a charging device 414, and a drum cleaning device 415. The photoconductor drum 413 is, for example, a negative-charging-type organic photoconductor. The surface of the photoconductor drum 413 has a photoconductive property. The photoconductor drum 413 corresponds to a photoconductor. The charging device 414 is, for example, a corona charger. The charging device 414 may be a contact charging device in which charging is carried out by bringing a contact charging member, such as a charging roller, a charging brush, or a charging blade, into contact with the photoconductor drum 413. The exposing device 411 includes, for example, a semiconductor laser as a light source and an optical deflection device (a polygonal motor) which irradiates the photoconductor drum 413 with a laser beam according to an image to be formed.

The developing device 412 is a developing device of a two-component development system. The developing device 412 includes, for example, a developing container accommodating a two-component developer, a developing roller (a magnetic roller) rotatably disposed at an opening of the developing container, a partition wall partitioning the inside of the developing container such that the two-component developer is allowed to be communicated, a conveying roller used for conveying the two-component developer at the opening side in the developing container toward the developing roller, and a stirring roller used for stirring the two-component developer in the developing container. The above-described toner is accommodated as a two-component developer in the developing container.

The intermediate transfer unit 42 includes an intermediate transfer belt 421, a primary transfer roller 422 bringing the intermediate transfer belt 421 into press contact with the photoconductor drum 413, a plurality of supporting rollers 423 including a backup roller 423A, and a belt cleaning device 426. The intermediate transfer belt 421 is tightly tensioned onto the plurality of supporting rollers 423 in a loop shape. The intermediate transfer belt 421 runs at a constant speed in the arrow A direction by rotating at least one driving roller among the plurality of supporting rollers 423.

The secondary transfer unit 43 includes a secondary transfer belt 432 of an endless form, and a plurality of supporting rollers 431 including a secondary transfer roller 431A. The secondary transfer belt 432 is tightly tensioned by the secondary transfer roller 431A and the supporting roller 431 in a loop shape.

The fixing device 60 includes, for example, a fixing roller 62, a heat generation belt 63 of an endless form which covers the outer circumferential surface of the fixing roller 62 and is used for heating and melting a toner configuring a toner image on a sheet S, and a pressure roller 64 pressing the sheet S against the fixing roller 62 and the heat generation belt 63. The sheet S corresponds to a recording medium.

The image forming apparatus 1 further includes an image reading section 110, an image processing section 30, and a sheet conveyance section 50. The image reading section 110 includes a sheet feeding device 111 and a scanner 112. The sheet conveyance section 50 includes a sheet feeding section 51, a sheet discharging section 52, and a conveyance path section 53. The sheets S (a standard sheet and a special sheet) which are identified based on the basis weight and the size are accommodated in three sheet feeding tray units 51*a* to 51*c* constituting the sheet feeding section 51 for each type which is set in advance. The conveyance path section 53 includes a plurality of pairs of conveyance rollers such as a pair of resist rollers 53*a*.

The image formation by the image forming apparatus 1 will be described.

The scanner 112 optically scans a document D on a contact glass to read the document D. The reflected light from the document D is read by a CCD sensor 112*a* and is turned into input image data. The input image data is subjected to predetermined image processing in the image processing section 30 and then the processed data is transferred to the exposing device 411.

The photoconductor drum 413 rotates at a constant circumferential speed. The charging device 414 negatively charges the surface of the photoconductor drum 413 with uniformity. In the exposing device 411, a polygonal mirror of the polygonal motor rotates at a high speed, and a laser beam corresponding to the input image data of each color component is developed along an axis direction of the photoconductor drum 413 and is emitted to the outer circumferential surface of the photoconductor drum 413 along the axis direction. In this way, an electrostatic latent image is formed on the surface of the photoconductor drum 413.

In the developing device 412, the toner particles are charged by stirring and conveying the two-component developer in the developing container, the two-component developer is conveyed to the developing roller, and thus a magnetic brush is formed on the surface of the developing roller. The charged toner particles are electrostatically attached to a portion of the electrostatic latent image of the photoconductor drum 413 from the magnetic brush. In this way, the electrostatic latent image on the surface of the photoconductor drum 413 is visualized, and thus a toner image corresponding to the electrostatic latent image is formed on the surface of the photoconductor drum 413.

The toner image on the surface of the photoconductor drum 413 is transferred to the intermediate transfer belt 421 by the intermediate transfer unit 42. A transfer residual toner remaining on the surface of the photoconductor drum 413 after transfer is removed by the drum cleaning device 415 including a drum cleaning blade which comes in slide contact with the surface of the photoconductor drum 413.

When the intermediate transfer belt 421 comes in press contact with the photoconductor drum 413 by the primary transfer roller 422, a primary transfer nip is formed for each photoconductor drum by the photoconductor drum 413 and the intermediate transfer belt 421. In the primary transfer nip, toner images of respective colors are sequentially superimposed and transferred to the intermediate transfer belt 421.

On the other hand, the secondary transfer roller 431A comes in press contact with the backup roller 423A via the intermediate transfer belt 421 and the secondary transfer belt 432. According to this, a secondary transfer nip is formed by the intermediate transfer belt 421 and the secondary transfer belt 432. The sheet S passes through the secondary transfer nip. The sheet S is conveyed to the secondary transfer nip by the sheet conveyance section 50. The correction of tilt of the sheet S and the adjustment of conveyance timing of the sheet S are performed by a resist roller section provided with the pair of resist rollers 53*a*.

When the sheet S is conveyed to the secondary transfer nip, a transfer bias is applied to the secondary transfer roller 431A. A toner image supported by the intermediate transfer belt 421 is transferred to the sheet S by applying the transfer bias. The sheet S to which the toner image is transferred is conveyed by the secondary transfer belt 432 to the fixing device 60.

The fixing device 60 forms a fixing nip by the heat generation belt 63 and the pressure roller 64 and heats and presses the conveyed sheet S by the fixing nip portion. The toner particles constituting the toner image on the sheet S are heated, the crystal nucleating agent part and the crystalline resin or the crystalline resin unit are rapidly melted therein, and as a result, the entire toner particles are rapidly melted at a relatively small heat quantity, thereby attaching the toner components to the sheet S. In the attached molten toner components, the crystal nucleating agent part and the peripheral part are rapidly crystallized, and thus the entire components are rapidly solidified. In this way, the toner image is rapidly fixed to the sheet S at a relatively small heat quantity. The sheet S to which the toner image is fixed is discharged to the outside of the apparatus by the sheet discharging section 52 provided with a discharge roller 52*a* so that an image with high image quality is formed.

Incidentally, a transfer residual toner remaining on the surface of the intermediate transfer belt 421 after secondary transfer is removed by the belt cleaning device 426 including a belt cleaning blade which comes in slide contact with the surface of the intermediate transfer belt 421.

EXAMPLES

The present invention will be described in more detail by means of the following examples and comparative examples. Incidentally, the present invention is not limited to the following examples and the like.

[Measurement Method]

(Melting Point (Tc) and Glass Transition Temperature (Tg) of Each Resin)

The melting point and the glass transition temperature of each resin constituting the toner are obtained by performing differential scanning calorimetry on each resin. In the differential scanning calorimetry, for example, a differential scanning calorimeter "DIAMOND DSC" (manufactured by PerkinElmer Inc.) is used. The measurement is carried out on measurement conditions (temperature increasing/cooling conditions) of performing, in this order, a first temperature increasing process of increasing a temperature from room temperature (25° C.) to 150° C. at a temperature increasing rate of 10° C./min and then isothermally maintaining at 150° C. for 5 minutes, a cooling process of cooling from 150° C. to 0° C. at a cooling rate of 10° C./min and then isothermally maintaining at 0° C. for 5 minutes, and a second temperature increasing process of increasing a temperature from 0° C. to 150° C. at a temperature increasing rate of 10° C./min. The measurement is performed in such a manner that 3.0 mg of a toner is sealed in an aluminum pan and set on a sample holder of a differential scanning calorimeter "DIAMOND DSC" An empty aluminum pan is used as a reference.

In the above measurement, a top temperature of a melting peak of the resin in the first temperature increasing process (an endothermic peak having a full width at half maximum within 15° C.) is designated as a melting point (Tc) of the resin. Further, regarding the amorphous resin, in the above measurement, an onset temperature obtained by an endothermic curve obtained from the first temperature increasing process is designated as a glass transition temperature Tg1, and onset temperatures obtained from the second temperature increasing process are designated as glass transition temperatures Tg1 and Tg2 (° C.), respectively.

(Measurement of Weight Average Molecular Weight (Mw))

Regarding the weight average molecular weight (Mw) (in terms of polystyrene) of each resin, "HLC-8220" (manufactured by Tosoh Corporation) as a GPC apparatus and "TSK GUARD COLUMN+TSK GEL SUPER HZM-M3 CONTINUOUS" (manufactured by Tosoh Corporation) as a column are used. The column temperature maintained at 40° C., and tetrahydrofuran (THF) as a carrier solvent is allowed to flow at a flow rate of 0.2 ml/min. A resin of a measurement sample is dissolved in tetrahydrofuran so as to have a concentration of 1 mg/ml on the dissolving condition in which treatment is performed at room temperature for 5 minutes using an ultrasonic dispersion apparatus. The obtained solution is treated with a membrane filter having a pore size of 0.2 μm to thereby obtain a sample solution. Further, 10 μL of this sample solution is injected in the GPC apparatus with the carrier solvent. Then, each component in the resin is detected by using a refractive index detector (RI detector), and the molecular weight, distribution of the measurement sample is calculated by using a calibration curve measured by using monodispersed polystyrene standard particles.

The calibration curve is created by using, for example, polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, which are produced by Pressure Chemical Company, as a standard polystyrene sample for calibration curve measurement and by measuring at least about ten points of the standard polystyrene samples. A refractive index detector is used as a detector in this measurement.

(Average Particle Diameter of Resin Particles, Colorant Particles, or the Like)

The volume average particle diameter (volume-based median diameter) of the resin particles, the colorant particles, or the like was measured by "UPA-150" (manufactured by MicrotracBEL Corporation).

[Preparation of Mold-Releasing Agent Particle Dispersion $D_W$]

A solution obtained by mixing 60 parts by mass of behenic acid behenate (melting point: 73° C.) as a mold-releasing agent, 5 parts by mass of an ionic surfactant "NEOGEN RK" (manufactured by DKS Co. Ltd.), and 240 parts by mass of ion exchange water was heated to 95° C., sufficiently dispersed by using a homogenizer "ULTAA-TURRAX T50" (manufactured by IKA), and then subjected to a dispersion treatment by using a pressure discharge-type GAULIN homogenizer, thereby preparing a mold-releasing agent particle dispersion $D_W$ having a solid content of 20 parts by mass. The volume average particle diameter of the particles in this mold-releasing agent particle dispersion $D_W$ was 240 nm.

[Synthesis of Hybrid Resin HB1]

A monomer solution Ma1 containing raw material monomers of an addition polymerization resin and a radical polymerization initiator to be described below was put into a dropping funnel.

| | |
|---|---|
| Styrene | 70 parts by mass |
| Butyl acrylate | 18 parts by mass |
| Acrylic acid | 8 parts by mass |
| Di-t-butyl peroxide | 14 parts by mass |

Further, a crystal nucleating agent to be described below was put into a four-necked flask equipped with a nitrogen inlet tube, a dehydration tube, a stirrer, and a thermocouple, and then heated to 170° C. so as to be dissolved.

| | |
|---|---|
| Arachidyl alcohol | 5.1 parts by mass |

Next, the Ma1 was added dropwise under stirring for 90 minutes and aged for 60 minutes, and then an unreacted component in the Ma1 was removed under reduced pressure (8 kPa).

Next, 0.1 part by mass of $Ti(OBu)_4$ as an esterification catalyst was put into the obtained reaction solution, and the resultant solution was heated to 235° C., reacted under normal pressure (101.3 kPa) for 2 hours, and further reacted under reduced pressure (8 kPa) for 1 hour.

Next, the obtained reaction solution was cooled to 200° C. and reacted under reduced pressure (20 kPa) for 1 hour, thereby obtaining a hybrid resin HB1 having a shape in which the main chain was a styrene acrylic resin (StAc) and arachidyl alcohol as a crystal nucleating agent part was grafted to the side chain by an ester bond (Es). The weight average molecular weight (Mw) of the hybrid resin HB1 was 14,000.

[Synthesis of Hybrid Resins HB2 to HB5]

Hybrid resins HB2 to HB5 were prepared in the same manner as in the synthesis of the hybrid resin HB1, except that the types of the crystal nucleating agent were changed as described in Table 1. The Mw of each of the hybrid resins HB2 to HB5 is presented in Table 1.

[Synthesis of Hybrid Resin HB6]

A hybrid resin HB6 having a shape in which the main chain was a styrene acrylic resin and palmitic acid as a crystal nucleating agent part grafted to the side chain was obtained in the same manner as in the synthesis of the hybrid resin HB1, except that allyl alcohol was used instead of acrylic acid and palmitic acid was used instead of arachidyl alcohol. The Mw of the hybrid resin HB6 was 15,000.

[Synthesis of Hybrid Resins HB7 to HB11]

Hybrid resins HB7 to HB11 were prepared in the same manner as in the synthesis of the hybrid resin HB6, except that the types of the crystal nucleating agent were changed as described in Table 1. The Mw of each of the hybrid resins HB7 to HB11 is presented in Table 1.

[Synthesis of Hybrid Resins HB12 to HB14]

Hybrid resins HB12 to HB14 were prepared in the same manner as in the synthesis of the hybrid resin HB8, except that the added amounts of the main chain and stearic acid with respect to the entire binder resin were changed as described in Table 1. The Mw of each of the hybrid resins HB12 to HB14 is presented in Table 1.

[Synthesis of Hybrid Resin HB15]

A mixture of a dually reactive monomer and a crystal nucleating agent to be described below was put into a four-necked flask equipped with a nitrogen inlet tube, a dehydration tube, a stirrer, and a thermocouple, and then heated to 170° C. so as to be dissolved.

| | |
|---|---|
| Stearic acid | 12 parts by mass |
| 2-Butene-1,4-diol | 2 parts by mass |

Next, 0.1 part by mass of $Ti(OBu)_4$ as an esterification catalyst was put into the obtained solution, and the resultant solution was heated to 235° C., reacted under normal pressure (101.3 kPa) for 2 hours, and further reacted under reduced pressure (8 kPa) for 1 hour, thereby obtaining a reaction solution.

Meanwhile, a solution Ma2 containing raw material monomers of an addition polymerization resin (styrene acrylic resin: StAc) unit and a radical polymerization initiator to be described below was put into a dropping funnel.

| | |
|---|---|
| Styrene | 92 parts by mass |
| n-Butyl acrylate | 24 parts by mass |
| Acrylic acid | 11 parts by mass |
| Di-t-butyl peroxide | 15 parts by mass |

Next, the Ma2 was added dropwise to the reaction solution under stirring for 90 minutes and aged for 60 minutes, and then an unreacted component in the Ma2 was removed under reduced pressure (8 kPa). Incidentally, the amount of the component removed at this time was a minute amount compared to the ratio of the total amount of the addition polymerization monomer components in the Ma2 to the total amount of the raw material monomers.

Next, the obtained reaction solution was cooled to 170° C. and reacted under reduced pressure (20 kPa) for 1 hour, thereby synthesizing a hybrid resin HB15 having a grafted shape in which the main chain was a resin chain containing stearic acid as a crystal nucleating agent part and the side chain was a styrene acrylic resin. The Mw of the hybrid resin HB15 was 15,000.

[Synthesis of Hybrid Resin HB16]

A solution Ma3 containing raw material monomers of an addition polymerization resin (styrene acrylic resin: StAc) unit, which contains a dually reactive monomer, and a radical polymerization initiator to be described below was put into a dropping funnel.

| | |
|---|---|
| Styrene | 80 parts by mass |
| n-Butyl acrylate | 20 parts by mass |
| Acrylic acid | 10 parts by mass |
| Di-t-butyl peroxide | 16 parts by mass |

Further, raw material monomers of a polycondensation resin (amorphous polyester resin: APEs) unit to be described below were put into a four-necked flask equipped with a nitrogen inlet tube, a dehydration tube, a stirrer, and a thermocouple, and then heated to 170° C. so as to be dissolved, thereby obtaining a solution Mb1.

| | |
|---|---|
| Bisphenol A with 2 mol propylene oxide adduct | 80 parts by mass |
| Terephthalic acid | 19 parts by mass |
| Fumaric acid | 13 parts by mass |

Next, the Ma3 was added dropwise to the Mb1 under stirring for 90 minutes and aged for 60 minutes, and then an unreacted component in the Ma3 was removed from the obtained reaction solution under reduced pressure (8 kPa).

Next, 0.2 part by mass of $Ti(OBu)_4$ as an esterification catalyst was put into the reaction solution, and the resultant solution was heated to 235° C., reacted under normal pressure (101.3 kPa) for 5 hours, and further reacted under reduced pressure (8 kPa) for 1 hour.

Next, the obtained reaction solution was cooled to 200° C., and then reacted under reduced pressure (20 kPa) until the temperature reached a desired softening point. Subsequently, the reaction solution was desolvated to thereby obtain a hybrid resin HB16 having a shape in which the main chain was a styrene acrylic resin and an amorphous polyester resin was grafted to the side chain. The glass transition temperature Tg1 of the hybrid resin HB16 was 61° C. and the Mw thereof was 19,000.

[Synthesis of Hybrid Crystalline Resin HBC1]

A solution Ma4 containing raw material monomers of an addition polymerization resin, a dually reactive monomer, and a radical polymerization initiator to be described below was put into a dropping funnel.

| | |
|---|---|
| Styrene | 35 parts by mass |
| Butyl acrylate | 9 parts by mass |
| Acrylic acid | 4 parts by mass |
| Di-t-butyl peroxide | 7 parts by mass |

Further, raw material monomers of a polycondensation resin and a crystal nucleating agent to be described below were put into a four-necked flask equipped with a nitrogen inlet tube, a dehydration tube, a stirrer, and a thermocouple, and then heated to 170° C. so as to be dissolved, thereby obtaining a solution Mb2.

| | |
|---|---|
| Adipic acid | 118 parts by mass |
| 1,9-Nonanediol | 130 parts by mass |
| Arachidyl alcohol | 12.5 parts by mass |

Next, the Ma4 was added dropwise to the Mb2 under stirring for 90 minutes and aged for 60 minutes, and then an unreacted component in the Ma4 was removed under reduced pressure (8 kPa).

Next, 0.8 part by mass of $Ti(OBu)_4$ as an esterification catalyst was put into the obtained reaction solution, and the resultant solution was heated to 235° C., reacted under normal pressure (101.3 kPa) for 5 hours, and further reacted under reduced pressure (8 kPa) for 1 hour.

Next, the obtained reaction solution was cooled to 200° C., and then reacted under reduced pressure (20 kPa) for 1 hour, thereby obtaining a hybrid crystalline resin HBC1 having a shape in which the main chain was a styrene acrylic resin, and a crystalline polyester resin and arachidyl alcohol as a crystal nucleating agent part were grafted to the side chain. The Mw of the hybrid crystalline resin HBC1 was 14,500, and the melting point thereof was 62° C.

[Synthesis of Hybrid Crystalline Resins HBC2 to HBC5]

Hybrid crystalline resins HBC2 to HBC5 were prepared in the same manner as in the synthesis of the hybrid crystalline resin HBC1, except that the types of the crystal nucleating agent were changed as described in Table 2. The Mw and the melting point of each of the hybrid crystalline resins HBC2 to HBC5 are presented in Table 2.

[Synthesis of Hybrid Crystalline Resin HBC6]

A hybrid crystalline resin HBC6 having a shape in which the main chain was a styrene acrylic resin, and a crystalline polyester resin and palmitic acid as a crystal nucleating agent part were grafted to the side chain was obtained in the same manner as in the synthesis of the hybrid crystalline resin HBC1, except that allyl alcohol was used instead of acrylic acid and palmitic acid was used instead of arachidyl alcohol. The Mw of the hybrid crystalline resin HBC6 was 14,000, and the melting point thereof was 62° C.

[Synthesis of Hybrid Crystalline Resins HBC7 to HBC11]

Hybrid crystalline resins HBC7 to HBC11 were prepared in the same manner as in the synthesis of the hybrid crystalline resin HBC6, except that the types of the crystal nucleating agent were changed as described in Table 2. The Mw and the melting point of each of the hybrid crystalline resins HBC7 to HBC11 are presented in Table 2.

[Synthesis of Hybrid Crystalline Resins HBC12 to HBC14]

Hybrid crystalline resins HBC12 to HBC14 were prepared in the same manner as in the synthesis of the hybrid crystalline resin HBC8, except that the added amounts of the main chain, the first side chain, and stearic acid with respect to the entire binder resin were changed as described in Table 2. The Mw and the melting point of each of the hybrid crystalline resins HBC12 to HBC14 are presented in Table 2.

[Synthesis of Hybrid Crystalline Resin HBC15]

A mixture of a dually reactive monomer and a crystal nucleating agent to be described below was put into a four-necked flask equipped with a nitrogen inlet tube, a dehydration tube, a stirrer, and a thermocouple, and then heated to 170° C. so as to be dissolved, thereby obtaining a solution Mb3.

| | |
|---|---|
| Stearic acid | 14 parts by mass |
| Ethylene glycol | 3.5 parts by mass |
| Methylenesuccinic acid | 5 parts by mass |

Next, 0.1 part by mass of $Ti(OBu)_4$ as an esterification catalyst was put into the Mb3, and the resultant solution was heated to 235° C., reacted under normal pressure (101.3 kPa) for 2 hours, and further reacted under reduced pressure (8 kPa) for 1 hour, thereby obtaining a reaction solution.

Meanwhile, raw material monomers of an addition polymerization resin (styrene acrylic resin: StAc) unit, raw material monomers of a polycondensation resin, and a radical polymerization initiator to be described below were put into a dropping funnel, and the resultant solution was heated to 170° C. so as to be dissolved, thereby obtaining a solution Ma5.

| | |
|---|---|
| Styrene | 71 parts by mass |
| n-Butyl acrylate | 18 parts by mass |
| Acrylic acid | 8 parts by mass |
| Di-t-butyl peroxide | 15 parts by mass |
| Adipic acid | 7 parts by mass |
| 1,9-Nonanediol | 7 parts by mass |
| $Ti(OBu)_4$ | 0.1 part by mass |

Next, the Ma5 was added dropwise to the reaction solution under stirring for 90 minutes, and the resultant solution was heated to 235° C., reacted under normal pressure (101.3 kPa) for 5 hours, and further reacted under reduced pressure (8 kPa) for 1 hour. Subsequently, an unreacted component in the Ma5 was removed from the obtained reaction solution under reduced pressure (8 kPa). Incidentally, the amount of the component removed at this time was a minute amount compared to the ratio of the total amount of the addition polymerization monomer components in the Ma5 to the total amount of the raw material monomers.

Next, the obtained reaction solution was cooled to 170° C. and reacted under reduced pressure (20 kPa) for 1 hour, thereby synthesizing a hybrid crystalline resin HBC15 having a graft configuration in which the main chain was a resin chain containing stearic acid as a crystal nucleating agent part and the side chain was a crystalline polyester resin and a styrene acrylic resin. The Mw of the hybrid crystalline resin HBC15 was 14,000, and the melting point thereof was 62° C.

[Synthesis of Hybrid Crystalline Resin HBC16]

A solution Ma6 containing a dually reactive monomer, raw material monomers of an addition polymerization resin, and a radical polymerization initiator to be described below was put into a dropping funnel.

| | |
|---|---|
| Styrene | 34 parts by mass |
| Butyl acrylate | 8 parts by mass |
| 2-Butene-1,4-diol | 3 parts by mass |
| Di-t-butyl peroxide | 7 parts by mass |

Further, raw material monomers of a polycondensation resin to be described below were put into a four-necked flask equipped with a nitrogen inlet tube, a dehydration tube, a stirrer, and a thermocouple, and then heated to 170° C. so as to be dissolved, thereby obtaining a solution Mb4.

| | |
|---|---|
| Adipic acid | 122 parts by mass |
| 1,9-Nonanediol | 134 parts by mass |

Next, the Ma6 was added dropwise to the Mb4 under stirring for 90 minutes and aged for 60 minutes, and then an unreacted component in the Ma6 was removed under reduced pressure (8 kPa).

Next, 0.8 part by mass of $Ti(OBu)_4$ as an esterification catalyst was put into the obtained reaction solution, and the resultant solution was heated to 235° C., reacted under normal pressure (101.3 kPa) for 5 hours, and further reacted under reduced pressure (8 kPa) for 1 hour.

Next, the obtained reaction solution was cooled to 200° C., and then reacted under reduced pressure (20 kPa) for 1 hour, thereby obtaining a hybrid crystalline resin HBC16 having a shape in which the main chain was a styrene acrylic resin and a crystalline polyester resin was grafted to the side chain. The Mw of the hybrid crystalline resin HBC16 was 15,000, and the melting point thereof was 62° C.

[Synthesis of Hybrid Crystalline Resin HBC17]

Into a reaction vessel equipped with a nitrogen inlet tube, a dehydration tube, a stirrer, and a thermocouple, 174 parts by mass of 1,10-decanediol as an alcohol monomer and 202 parts by mass of 1,10-decanedioic acid as an acid monomer were put.

Next, 1 part by mass of tin dioctylate as a catalyst was added thereto with respect to 100 parts by mass of the total mass of the monomers, and the resultant mixture was heated to 140° C. under a nitrogen atmosphere and reacted for 7 hours under normal pressure while water was distilled away. Thereafter, the reaction was carried out while the temperature was raised to 200° C. at 10° C./hr, the reaction was carried out for 2 hours after the temperature reached 190° C., and then the reaction was carried out at 190° C. for 3 hours while the reaction vessel was reduced in the pressure therein to 5 kPa or less.

Next, the reaction vessel was gradually opened to be returned the pressure therein to normal pressure, 11.4 parts by mass of stearic acid as a crystal nucleating agent part was added, and then the reaction was carried out at 200° C. for 2 hours under normal pressure.

Next, the inside of the reaction vessel was reduced again in pressure to 5 kPa or less, and the reaction was carried out at 190° C. for 3 hours, thereby obtaining a hybrid crystalline resin HBC17 having a shape in which stearic acid as a crystal nucleating agent part was bonded to the terminal of the crystalline polyester resin chain. The Mw of the hybrid crystalline resin HBC17 was 20,000, and the melting point thereof was 76° C.

The composition, the melting point of the crystal nucleating agent, and the Mw of the hybrid resin in each of the hybrid resins HB1 to HB16 are presented in Table 1. The composition, the melting point of the crystal nucleating agent, and the melting point and the Mw of the hybrid crystalline resin in each of the hybrid crystalline resins HBC1 to HBC17 are presented in Table 2. In the tables, "HB, "HBC," "StAc," "UPEs," "Es," "CPEs," and "APEs" mean a hybrid resin, a hybrid crystalline resin, a styrene-acrylic-based copolymer unit, an unsaturated polyester resin unit, an ester, a crystalline polyester resin unit, and an amorphous polyester resin unit, respectively.

TABLE 1

| | Main chain | | | | Side chain | | | | |
|---|---|---|---|---|---|---|---|---|---|
| | | Crystal nucleating agent | | | | Crystal nucleating agent | | | |
| HB No. | Type | Type | Melting point (° C.) | Amount (% by mass ) | Type | Type | Melting point (° C.) | Amount (% by mass) | Mw of HB (—) |
| 1 | StAc | — | — | 95 | Es | Arachidyl alcohol | 64 | 5 | 14000 |
| 2 | StAc | — | — | 95 | Es | Behenyl alcohol | 66 | 5 | 13500 |
| 3 | StAc | — | — | 95 | Es | 1-Tetracosanol | 77 | 5 | 15500 |
| 4 | StAc | — | — | 95 | Es | 1-Hexacosanol | 79 | 5 | 15000 |
| 5 | StAc | — | — | 95 | Es | Octacosanol | 82 | 5 | 14500 |
| 6 | StAc | — | — | 95 | Es | Palmitic acid | 63 | 5 | 15000 |
| 7 | StAc | — | — | 95 | Es | Margaric acid | 61 | 5 | 15000 |
| 8 | StAc | — | — | 95 | Es | Stearic acid | 70 | 5 | 14500 |
| 9 | StAc | — | — | 95 | Es | Arachidic acid | 76 | 5 | 14000 |
| 10 | StAc | — | — | 95 | Es | Behenic acid | 75 | 5 | 13500 |
| 11 | StAc | — | — | 95 | Es | Lignoceric acid | 86 | 5 | 14000 |
| 12 | StAc | — | — | 99.5 | Es | Stearic acid | 70 | 0.5 | 15000 |
| 13 | StAc | — | — | 90 | Es | Stearic acid | 70 | 10 | 14500 |
| 14 | StAc | — | — | 88 | Es | Stearic acid | 70 | 12 | 14500 |
| 15 | UPEs | Stearic acid | 70 | 10 | StAc | — | — | 90 | 15000 |
| 16 | StAc | — | — | 95 | APEs | — | — | 5 | 19000 |

TABLE 2

| | Main chain | | | | | | Second side chain | | | | | |
|---|---|---|---|---|---|---|---|---|---|---|---|---|
| | Crystal nucleating agent | | | | First side chain | | Crystal nucleating agent | | | | | |
| HBC No. | Type | Type | Melting point (° C.) | Amount (% by mass) | Type | Amount (% by mass) | Type | Type | Melting point (° C.) | Amount (% by mass) | Melting point of HBC (° C.) | Mw of HBC (—) |
| 1 | StAc | — | — | 16 | CPEs | 80 | Es | Arachidyl alcohol | 64 | 4 | 62 | 14500 |
| 2 | StAc | — | — | 16 | CPEs | 80 | Es | Behenyl alcohol | 66 | 4 | 62 | 15000 |
| 3 | StAc | — | — | 16 | CPEs | 80 | Es | 1-Tetracosanol | 77 | 4 | 62 | 14000 |
| 4 | StAc | — | — | 16 | CPEs | 80 | Es | 1-Hexacosanol | 79 | 4 | 62 | 14000 |
| 5 | StAc | — | — | 16 | CPEs | 80 | Es | Octacosanol | 82 | 4 | 62 | 13500 |
| 6 | StAc | — | — | 16 | CPEs | 80 | Es | Palmitic acid | 63 | 4 | 62 | 14000 |
| 7 | StAc | — | — | 16 | CPEs | 80 | Es | Margaric acid | 61 | 4 | 62 | 15500 |
| 8 | StAc | — | — | 16 | CPEs | 80 | Es | Stearic acid | 70 | 4 | 62 | 14000 |
| 9 | StAc | — | — | 16 | CPEs | 80 | Es | Arachidic acid | 76 | 4 | 62 | 15000 |
| 10 | StAc | — | — | 16 | CPEs | 80 | Es | Behenic acid | 75 | 4 | 62 | 14500 |

TABLE 2-continued

| | Main chain | | | | | | Second side chain | | | | | |
|---|---|---|---|---|---|---|---|---|---|---|---|---|
| | | Crystal nucleating agent | | | First side chain | | Crystal nucleating agent | | | | Melting | |
| HBC No. | Type | Type | Melting point (° C.) | Amount (% by mass) | Type | Amount (% by mass) | Type | Type | Melting point (° C.) | Amount (% by mass) | point of HBC (° C.) | Mw of HBC (—) |
| 11 | StAc | — | — | 16 | CPEs | 80 | Es | Lignoceric acid | 86 | 4 | 62 | 14500 |
| 12 | StAc | — | — | 16 | CPEs | 84.5 | Es | Stearic acid | 70 | 0.5 | 62 | 15000 |
| 13 | StAc | — | — | 16 | CPEs | 75 | Es | Stearic acid | 70 | 10 | 62 | 13500 |
| 14 | StAc | — | — | 8 | CPEs | 80 | Es | Stearic acid | 70 | 12 | 62 | 14000 |
| 15 | UPEs | Stearic acid | 70 | 10 | CPEs | 10 | StAc | — | — | — | 62 | 14000 |
| 16 | StAc | — | — | 15 | CPEs | 85 | — | — | — | — | 62 | 15000 |
| 17 | CPEs | — | — | 97 | — | — | — | — | — | — | 76 | 20000 |
| | — | Stearic acid | 70 | 3 | | | | | | | | |

[Preparation of Aqueous Dispersion $D_{HB1}$]

100 parts by mass of the hybrid resin HB1 was dissolved in 100 parts by mass of ethyl acetate, and while this solution was stirred, an aqueous solution in which sodium polyoxyethylene lauryl ether sulfate was dissolved in 400 parts by mass of ion exchange water so as to have a concentration of 1% by mass was gradually added dropwise to the above solution. Ethyl acetate was removed from the obtained solution under reduced pressure, and then pH of the resultant solution was adjusted with ammonia to be 8.5. Thereafter, the solid content concentration was adjusted to 20% by mass. In this way, a dispersion $D_{HB1}$ in which the fine particles of the hybrid resin HB1 were dispersed in an aqueous medium was prepared. The volume-based median diameter of the particle included in the dispersion $D_{HB1}$ was 210 nm.

[Preparation of Aqueous Dispersions $D_{HB2}$ to $D_{HB16}$]

Each of dispersions $D_{HB2}$ to $D_{HB16}$ in which the fine particles of each of the hybrid resins HB2 to HB16 were dispersed in an aqueous medium was obtained in the same manner as in the preparation of the dispersion $D_{HB1}$, except that each of the hybrid resins HB2 to HB16 was used instead of the hybrid resin HB1 in the preparation of the dispersion $D_{HB1}$. The volume-based median diameters of the particles included in the dispersions $D_{HB2}$ to $D_{HB16}$ all were in the range of 180 to 240 nm.

[Preparation of Aqueous Dispersions $D_{HBC1}$]

A dispersion $D_{HBC1}$ in which the fine particles of the hybrid resin HB1 were dispersed in an aqueous medium was prepared in the same manner as in the preparation of the dispersion $D_{HB1}$, except that the hybrid crystalline resin HBC1 was used instead of the hybrid resin HB1 in the preparation of the dispersion $D_{HB1}$. The volume-based median diameter of the particle included in the dispersion $D_{HBC1}$ was 200 nm.

[Preparation of Aqueous Dispersions $D_{HBC2}$ to $D_{HBC17}$]

Each of dispersion $D_{HBC2}$ to $D_{HBC17}$ in which the fine particles of each of the hybrid crystalline resins HBC2 to HBC17 were dispersed in an aqueous medium was obtained in the same manner as in the preparation of the dispersion $D_{HB1}$, except that each of the hybrid crystalline resins HBC2 to HBC17 was used instead of the hybrid resin HB1 in the preparation of the dispersion $D_{HB1}$. The volume-based median diameters of the particles included in the dispersions $D_{HBC2}$ to $D_{HBC17}$ all were in the range of 180 to 240 nm.

[Synthesis of Crystalline Resin C1]

Into a reaction container equipped with a stirrer, a thermometer, a condenser tube, and a nitrogen gas inlet tube, 293 parts by mass of adipic acid and 320 parts by mass of 1,9-nonanediol were put. The inside of the reaction container was replaced with dry nitrogen gas, 0.1 part by mass of $Ti(OBu)_4$ was then added thereto, and the resultant mixture was stirred and reacted at about 180° C. for 8 hours under a stream of the nitrogen gas.

To the obtained reaction solution, 0.2 part by mass of $Ti(OBu)_4$ was further added, the temperature was raised to about 220° C., and then the resultant mixture was stirred and reacted for 6 hours. Thereafter, the reaction container was reduced in the pressure therein to 10 mmHg, and the reaction was carried out under reduced pressure, thereby obtaining a crystalline resin C1. The Mw of the crystalline resin C1 was 13,000.

[Preparation of Aqueous Dispersion $D_{C1}$]

A dispersion $D_{C1}$ in which the fine particles of the crystalline resin C1 were dispersed in an aqueous medium was prepared in the same manner as in the preparation of the dispersion $D_{HB1}$, except that the crystalline resin C1 was used instead of the hybrid resin HB1 in the preparation of the dispersion $D_{HB1}$. The volume-based median diameter of the particle included in the dispersion $D_{C1}$ was 205 nm.

[Synthesis of Amorphous Resin X1 and Preparation of Aqueous Dispersion $D_{X1}$]

(First Polymerization)

To a 5 L reaction container equipped with a stirring device, a temperature sensor, a condenser tube, and a nitrogen gas-introducing device, 8 parts by mass of sodium dodecyl sulfate and 3000 parts by mass of ion exchange water were input, the internal temperature of the resultant mixture was raised to 80° C. while being stirred under a stream of nitrogen at a stirring speed of 230 rpm. Subsequently, a solution obtained by dissolving 10 parts by mass of potassium persulfate in 200 parts by mass of ion exchange water was added to the obtained solution, the temperature of the resultant solution was raised again to 80° C., a mixture solution formed of the following monomers was added dropwise to the obtained solution for 1 hour, and the resultant mixture was polymerized by heating and stirring at 80° C. for 2 hours, thereby preparing a dispersion (x1) of the resin fine particles.

| | |
|---|---|
| Styrene | 480 parts by mass |
| n-Butyl acrylate | 250 parts by mass |
| Methacryl acid | 68.0 parts by mass |

(Second Polymerization)

To a 5 L reaction container equipped with a stirring device, a temperature sensor, a condenser tube, and a nitrogen gas-introducing device, a solution obtained by dissolving 7 parts by mass of polyoxyethylene (2) sodium dodecyl ether sulfate in 3000 parts by mass of ion exchange water was input, and then heated to 98° C. To the above solution, 260 parts by mass of the dispersion (x1) of the resin fine particles and a solution obtained by dissolving a monomer formed by the following components and a mold-releasing agent at 90° C. were added. The resultant mixture was mixed and dispersed for 1 hour by a mechanical dispersion apparatus "CLEARMIX" (manufactured by M Technique Co., Ltd., "CLEARMIX" is a registered trademark of the company) equipped with a circulation path to thereby prepare a dispersion containing emulsion particles (oil droplets). The mold-releasing agent is behenic acid behenate (melting point: 73° C.)

| | |
|---|---|
| Styrene | 284 parts by mass |
| n-Butyl acrylate | 92 parts by mass |
| Methacryl acid | 13 parts by mass |
| n-Octyl-3-mercaptopropionate | 1.5 parts by mass |
| Behenic acid behenate | 190 parts by mass |

Next, to the above dispersion, an initiator solution obtained by dissolving 6 parts by mass of potassium persulfate in 200 parts by mass of ion exchange water was added, and the polymerization was carried out by heating and stirring the obtained dispersion at 84° C. for 1 hour, thereby preparing a dispersion (x2) of resin fine particles.

(Third Polymerization)

Further, 400 parts by mass of ion exchange water was added to the dispersion (x2) of resin fine particles and mixed well, and then a solution obtained by dissolving 11 parts by mass of potassium persulfate in 400 parts by mass of ion exchange water is added to the resultant mixture solution. A mixture solution formed of the following monomers was added dropwise to the obtained dispersion for 1 hour under the temperature condition of 82° C.

| | |
|---|---|
| Styrene | 350 parts by mass |
| n-Butyl acrylate | 215 parts by mass |
| Acrylic acid | 30 parts by mass |
| n-Octyl-3-mercaptopropionate | 8 parts by mass |

After the completion of dropwise addition, the polymerization was carried out by heating and stirring the resultant mixture for 2 hours, and then the obtained reaction solution was cooled to 28° C., thereby obtaining a dispersion $D_{X1}$ in which an amorphous resin X1 formed by a vinyl resin and the fine particles thereof were dispersed in an aqueous medium.

The volume-based median diameter of the fine particle included in the aqueous dispersion $D_{X1}$ was 220 nm. Further, the glass transition temperature Tg1 of the amorphous resin X1 was 55° C., and the Mw thereof was 32,000.

[Synthesis of Amorphous Resin X2]

Raw material monomers of a polycondensation resin (amorphous polyester resin) unit were put into a four-necked flask equipped with a nitrogen inlet tube, a dehydration tube, a stirrer, and a thermocouple, and then heated to 170° C. so as to be dissolved.

Bisphenol A with 2 mol propylene oxide adduct 285.7 parts by mass

| | |
|---|---|
| Terephthalic acid | 66.9 parts by mass |
| Fumaric acid | 47.4 parts by mass |

Next, 0.4 part by mass of $Ti(OBu)_4$ as an esterification catalyst was put into the obtained reaction solution, and the resultant solution was heated to 235° C., reacted under normal pressure (101.3 kPa) for 5 hours, and further reacted under reduced pressure (8 kPa) for 1 hour.

Next, the obtained reaction solution was cooled to 200° C., and then reacted under reduced pressure (20 kPa) until the temperature reached a desired softening point. Subsequently, the reaction solution was desolvated to thereby obtain an amorphous resin X2. The glass transition temperature Tg1 of the amorphous resin X2 was 61° C., and the Mw thereof was 19,000.

[Preparation of Aqueous Dispersion $D_{X2}$]

A solution obtained by dissolving 100 parts by mass of the amorphous resin X2 in 400 parts by mass of ethyl acetate (manufactured by KANTO CHEMICAL CO., INC.) was mixed with 638 parts by mass of a sodium lauryl sulfate solution having a concentration of 0.26% by mass which had been prepared in advance, and the resultant mixture was subjected to ultrasonic dispersion for 30 minutes at V-LEVEL of 300 μA by using an ultrasonic homogenizer "US-150T" (manufactured by NIHONSEIKI KAISHA LTD.) while being stirred. Subsequently, while the mixture was heated to 40° C., ethyl acetate was completely removed by a diaphragm vacuum pump "V-700" (manufactured by BUCHI Labortechnik AG) under reduced pressure under stirring for 3 hours. In this way, a dispersion $D_{X2}$ in which the fine particles of the amorphous resin X2 having a solid content of 13.5% by mass were dispersed in an aqueous medium was prepared. The volume-based median diameter of the dispersion $D_{X2}$ was 170 nm.

[Synthesis of Amorphous Resin X3]

The following components were put into a reaction vessel equipped with a nitrogen inlet tube, a dehydration tube, a stirrer, and a thermocouple in an amount to be described below, and then 1.6 parts by mass of dibutyltin was added as a catalyst with respect to 100 parts by mass of the total amount of monomers.

| | |
|---|---|
| Terephthalic acid | 166 parts by mass |
| Trimellitic acid | 21 parts by mass |
| Bisphenol A•propylene oxide 2 mol adduct | 103 parts by mass |
| Bisphenol A•ethylene oxide 2 mol adduct | 63 parts by mass |
| Ethylene glycol | 22 parts by mass |

Next, the resultant mixture was rapidly raised to 180° C. at normal pressure under a nitrogen atmosphere, and then water was distilled off while the mixture was heated from 180° C. to 220° C. at a temperature increasing rate of 10° C./hr, thereby performing polycondensation.

The inside of the reaction vessel was reduced to 5 kPa or less after the temperature of the obtained reaction solution reached 220° C., and then polycondensation was performed under the condition of 220° C. and 5 kPa or less, thereby obtaining an amorphous resin X3. The Mw of the amorphous resin X3 was 7000, and the glass transition temperature Tg2 thereof was 56° C.

[Preparation of Resin Composition Y1]

Into an autoclave reaction vessel equipped with a thermometer and a stirring device, 600 parts by mass of xylene, 500 parts by mass of low-molecular-weight polypropylene 1 (softening point: 156° C., viscosity at 160° C.: 1900 mPa·s, number average molecular weight: 9200), and 120 parts by mass of low-molecular-weight polyethylene (softening point: 128° C., viscosity at 140° C.: 600 mPa·s, number average molecular weight: 3800) were put and then sufficiently dissolved. Next, a mixed solution of 1900 parts by mass of styrene, 170 parts by mass of acrylonitrile, 240 parts by mass of monobutyl maleate, 78 parts by mass of di-t-butyl peroxyhexahydroterephthalate, and 455 parts by mass of xylene was added dropwise to the obtained solution after being replaced with nitrogen at 180° C. for 3 hours so as to be polymerized, and then the resultant mixture was further maintained at this temperature for 30 minutes. Next, the resultant mixture was desolvated to thereby obtain a resin composition Y1. The Mw of the resin composition Y1 was 10,500, and the Tg thereof was 84.2° C.

[Preparation of Colorant Fine Particle Aqueous Dispersion $D_{Cy}$]

90 parts by mass of sodium dodecyl sulfate was added to 1600 parts by mass of ion exchange water. While this solution was stirred, 420 parts by mass of copper phthalocyanine was gradually added, and then the dispersion treatment was performed by using a stirring device "CLEARMIX" (manufactured by M Technique Co., Ltd.), thereby preparing a colorant fine particle aqueous dispersion $D_{Cy}$. The average particle diameter (volume-based median diameter) of the colorant fine particles in the dispersion $D_{Cy}$ was 110 nm.

Example 1: Production of Cyan Developer 1

Into a reaction container equipped with a stirring device, a temperature sensor, and a condenser tube, 320 parts by mass (in terms of solid content) of the dispersion $D_{X1}$, 40 parts by mass (in terms of solid content) of the dispersion $D_{HB1}$, 40 parts by mass (in terms of solid content) of the dispersion $D_{C1}$, and 2000 parts by mass of ion exchange water were input, and then 5 mol/liter of an aqueous solution of sodium hydroxide was added thereto so that the pH was adjusted to 10.

Next, into the obtained dispersion, 30 parts by mass (in terms of solid content) of the dispersion $D_{Cy}$ was input, and then an aqueous solution obtained by dissolving 60 parts by mass of magnesium chloride in 60 parts by mass of ion exchange water was added thereto at 30° C. for 10 minutes under stirring. Thereafter, the resultant mixture was left to stand for 3 minutes, and then the temperature thereof was started to be raised. The temperature of the obtained mixed solution was raised to 80° C. over 60 minutes and then the particle growth reaction was continued while the temperature was maintained at 80° C.

In this state, the associated particle diameter was measured with "COULTER MULTISIZER 3" (manufactured by Beckman Coulter, Inc.), and then the particle growth was stopped at the time point when the volume-based median diameter became 6.4 μm, by adding an aqueous solution obtained by dissolving 190 parts by mass of sodium chloride in 760 parts by mass of ion exchange water in a dispersion in the reaction container.

Further, the fusion of particles was performed in such a manner that the temperature of the dispersion was raised and heated and stirred in a state of 90° C., and then the dispersion in the reaction container was cooled to 30° C. at a cooling rate of 2.5° C./min at the time point when the average circularity became 0.945 as measured by using an average circularity measurement apparatus "FPIA-2100" (manufactured by Sysmex Corporation) (HPF detection number was set to 4000).

Next, the dispersion was subjected to solid/liquid separation, an operation in which the dehydrated toner cake was re-dispersed in ion exchange water and subjected to solid/liquid separation was repeated three times, washing was conducted, and then drying was conducted at 40° C. for 24 hours, thereby obtaining a cyan toner parent particle 1X.

To 100 parts by mass of the cyan toner parent particle 1×, 0.6 part by mass of hydrophobic silica (number average primary particle diameter=12 nm, hydrophobicity degree=68) and 1.0 part by mass of hydrophobic titanium oxide (number average primary particle diameter=20 nm, hydrophobicity degree=63) were added, and then mixed by a "HENSCHEL MIXER" (manufactured by NIPPON COKE & ENGINEERING COMPANY, LIMITED) for 20 minutes at a rotary blade speed of 35 mm/sec and 32° C., and then coarse particles were removed by using a sieve with an opening of 45 pin. Such an external additive treatment was carried out to thereby produce a cyan toner particle 1. The volume average particle diameter of the cyan toner particle 1 was 6.3 μm.

A ferrite carried having a volume average particle diameter of 60 μm, which covered a silicone resin, was added and mixed with respect to the cyan toner particle 1 such that the toner particle concentration became 6% by mass, thereby producing a cyan developer 1 as a two-component developer.

Examples 2 to 13, 18, and 19: Production of Cyan Developers 2 to 13, 18, and 19

Each of cyan developers 2 to 13, 18, and 19 was produced in the same manner as in Example 1, except that each of the dispersions $D_{HB2}$ to $D_{HB15}$ was used instead of the dispersion $D_{HB1}$. The volume average particle diameters of the cyan toner particles 2 to 13, 18, and 19 all were in the range of 6.0 to 6.5 μm.

Examples 14, 15, and 17: Production of Cyan Developers 14, 15, and 17

Each of cyan developers 14, 15, and 17 was produced in the same manner as in Example 1, except that the added amount of each dispersion was changed such that the content ratios of the hybrid resin, the crystalline resin, and the amorphous resin in the binder resin became values presented in Table 3. The volume average particle diameters of the obtained cyan toner particles 14, 15, and 17 all were in the range of 6.0 to 6.5 μm.

Example 16: Production of Cyan Developer 16

Into a reaction container equipped with a stirring device, a temperature sensor, and a condenser tube, 320 parts by mass (in terms of solid content) of the dispersion $D_{X2}$, 40 parts by mass (in terms of solid content) of the dispersion $D_{HB8}$, 40 parts by mass (in terms of solid content) of the dispersion $D_{C1}$, and 2000 parts by mass of ion exchange water were input, and then 5 mol/liter of an aqueous solution of sodium hydroxide was added thereto so that the pH was adjusted to 10.

Next, into the obtained dispersion, 30 parts by mass (in terms of solid content) of the dispersion $D_{Cy}$ and 43 parts by mass (in terms of solid content) of the dispersion $D_W$ were input, and then an aqueous solution obtained by dissolving 60 parts by mass of magnesium chloride in 60 parts by mass of ion exchange water was added thereto at 30° C. for 10 minutes under stirring. Thereafter, the resultant mixture was left to stand for 3 minutes, and then the temperature thereof was started to be raised. The temperature of the obtained mixed solution was raised to 80° C. over 60 minutes and then the particle growth reaction was continued while the temperature was maintained at 80° C.

Thereafter, a cyan toner parent particle 16X was obtained in the same manner as in Example 1. Then, in the same manner as in Example 1, the external additive treatment was carried out on the cyan toner parent particle 16X to thereby obtain a cyan toner particle 16. The volume average particle diameter of the cyan toner particle 16 was 6.3 μm. Further, the cyan toner particle 16 was mixed with the carrier to thereby obtain a cyan developer 16.

Comparative Example 1: Production of Cyan Developer 20

A cyan developer 20 was produced in the same manner as in Example 1, except that the dispersion $D_{HB16}$ was used instead of the dispersion $D_{HB1}$. The volume average particle diameter of the cyan toner particle 20 was in the range of 6.0 to 6.5 μm.

Example 20: Production of Cyan Developer 21

Into a reaction container equipped with a stirring device, a temperature sensor, and a condenser tube, 350 parts by mass (in terms of solid content) of the dispersion $D_{X1}$, 50 parts by mass (in terms of solid content) of the dispersion $D_{HBC1}$, and 2000 parts by mass of ion exchange water were input, and then 5 mol/liter of an aqueous solution of sodium hydroxide was added thereto so that the pH was adjusted to 10.

Thereafter, a cyan toner parent particle 21X was obtained in the same manner as in Example 1. Then, in the same manner as in Example 1, the external additive treatment was carried out on the cyan toner parent particle 21X to thereby obtain a cyan toner particle 21. The volume average particle diameter of the cyan toner particle 21 was 6.5 μm. Further, the cyan toner particle 21 was mixed with the carrier to thereby obtain a cyan developer 21.

Examples 21 to 32, 37, and 38: Production of Cyan Developers 22 to 33, 38, and 39

Each of cyan developers 22 to 33, 38, and 39 was produced in the same manner as in Example 20, except that each of the dispersion $D_{HBC2}$ to $D_{HBC15}$ was used instead of the dispersion $D_{HBC1}$. The volume average particle diameters of the cyan toner particles 22 to 33, 38, and 39 all were in the range of 6.0 to 6.5 μm.

Examples 33, 34, and 36: Production of Cyan Developers 34, 35, and 37

Each of cyan developers 34, 35, and 37 was produced in the same manner as in Example 27, except that the added amount of each dispersion was changed such that the content ratios of the hybrid crystalline resin and the amorphous resin in the binder resin became values presented in Table 4. The volume average particle diameters of the cyan toner particles 34, 35, and 37 all were in the range of 6.0 to 6.5 μm.

Example 35: Production of Cyan Developer 36

Into a reaction container equipped with a stirring device, a temperature sensor, and a condenser tube, 350 parts by mass (in terms of solid content) of the dispersion $D_{X2}$, 50 parts by mass (in terms of solid content) of the dispersion $D_{HBC8}$, and 2000 parts by mass of ion exchange water were input, and then 5 mol/liter of an aqueous solution of sodium hydroxide was added thereto so that the pH was adjusted to 10.

Next, into the obtained dispersion, 30 parts by mass (in terms of solid content) of the dispersion $D_{Cy}$ and 43 parts by mass (in terms of solid content) of dispersion $D_W$ were input, and then an aqueous solution obtained by dissolving 60 parts by mass of magnesium chloride in 60 parts by mass of ion exchange water was added thereto at 30° C. for 10 minutes under stirring. Thereafter, the resultant mixture was left to stand for 3 minutes, and then the temperature thereof was started to be raised. The temperature of the obtained mixed solution was raised to 80° C. over 60 minutes and then the particle growth reaction was continued while the temperature was maintained at 80° C.

Thereafter, a cyan toner parent particle 36X was obtained in the same manner as in Example 1. Then, in the same manner as in Example 1, the external additive treatment was carried out on the cyan toner parent particle 36X to thereby obtain a cyan toner particle 36. The volume average particle diameter of the cyan toner particle 36 was 6.3 μm. Further, the cyan toner particle 36 was mixed with the carrier to thereby obtain a cyan developer 36.

Comparative Example 2: Production of Cyan Developer 40

A cyan developer 40 was produced in the same manner as in Example 20, except that the dispersion $D_{HBC16}$ was used instead of the dispersion $D_{HBC1}$. The volume average particle diameter of the cyan toner particle 40 was 6.5 μm.

Comparative Example 3: Production of Black Developer 1

| | |
|---|---|
| Hybrid crystalline resin HBC17 | 20 parts by mass |
| Amorphous resin X3 | 80 parts by mass |
| Resin composition Y1 | 3.5 parts by mass |
| Carbon black | 5.0 parts by mass |
| Fischer-Tropsch wax | 5.5 parts by mass |
| Aluminum 3,5-di-t-butylsalicylate compound | 0.4 part by mass |

The above materials were mixed with a HENSCHEL MIXER (FM-75 model, manufactured by NIPPON COKE & ENGINEERING COMPANY, LIMITED), and then the mixture was kneaded with a biaxial kneader (PCM-30 model, manufactured by IKEGAI, Ltd.) under the conditions of a rotation number of 3.3 $s^{-1}$ and a kneaded resin temperature of 140° C. Incidentally, the DSC peak temperature of the Fischer-Tropsch wax was 105° C.

The obtained kneaded product was cooled and then coarsely pulverized into products each having a size of 1 mm or less with a hammer mill, thereby obtaining coarsely pulverized products. The obtained coarsely pulverized products were finely pulverized with a mechanical type pulverizer (T-250, manufactured by Turbo Kogyo Co., Ltd.). Further, the obtained finely pulverized products were classified with a multi-division classifier utilizing Coanda effect, thereby obtaining a black toner parent particle 1 having a volume average particle diameter of 6.5 μm. Then, in the same manner as in Example 20, a black toner parent particle 1 having the same particle diameter was produced, and thus a black developer 1 serving as a two-component developer was produced.

[Evaluation of Cyan Developers 1 to 40 and Black Developer 1]

(1) Low-Temperature Fixability

The cyan developer 1 was filled in an evaluation machine, in which a fixing device of a copying machine "BIZHUB PRO C6501" (manufactured by Konica Minolta, Inc.) was modified such that the surface temperature of a heating roller for fixing was variable within the range of 100 to 210° C. Next, a fixing test in which a solid image having a toner attached amount of 11 mg/10 $cm^2$ was fixed onto A4-sized plain paper (basis weight: 80 $g/m^2$) was repeated until 130° C. while the fixing temperature to be set was changed at 5° C. intervals in the increasing manner from 85° C. The test was performed on each of the cyan developers 2 to 40 and the black developer 1.

Next, a printed article obtained in the fixing test of each developer was folded by a folding machine such that a load was applied to the solid image, compressed air of 0.35 MPa was blown thereto, the fold was ranked based on five stages indicated by the following evaluation criteria, and a fixing temperature in the fixing test corresponding to Rank 3, which was the lowest fixing temperature in the fixing tests, was evaluated as a lower limit of fixing temperature. The results thereof are presented in Table 3 and Table 4. As the lower limit of fixing temperature is lower, low-temperature fixability is more excellent, and when the lower limit of fixing temperature is 120° C. or lower, there is no practical problem and it is determined to be passing.

(Evaluation Criteria)

Rank 5: No fold is observed at all.

Rank 4: Peeling is slightly observed along the partial fold.

Rank 3: Fine-line-shaped peeling is observed along the fold.

Rank 2: Thick-line-shaped peeling is observed along the fold.

Rank 1: Large peeling is observed.

(2) Evaluation of High-Temperature Storage Stability

In a 10 ml glass bottle having an inner diameter of 21 mm, 0.5 g of each of the cyan developers 1 to 40 and the black developer 1 was charged, and after the glass bottle was closed with a lid, each glass bottle was shaken 600 times with a tap densor KYT-2000 (manufactured by SEISHIN ENTERPRISE Co., Ltd.) at room temperature, and after the lid was removed, each glass bottle was left to stand for 2 hours under the environment of 55° C. and 35% RH.

Next, the developer after being left to stand was placed on a sieve of 48 mesh (an opening of 350 μm) so as not to damage the aggregate of the developer, and was set on a powder tester (manufactured by HOSOKAWA MICRON CORPORATION), while fixing it with a pressure bar and a knob nut. The powder tester was adjusted to a vibration intensity of a feeding width of 1 mm, and vibration was applied thereto for 10 seconds. Thereafter, a ratio of the amount of the developer remaining on the sieve (toner aggregation ratio At, % by mass) was measured. The At is a value calculated by the following equation.

$$At\ (\%\ \text{by mass}) = (\text{Mass of developer remaining on sieve (g)})/0.5\ (\text{g}) \times 100$$

From the obtained At, the high-temperature storage stability of the developer was evaluated based on the following criteria. The cases of having results of ⊙ to Δ are determined to be passing.

(Evaluation Criteria)

⊙: a toner aggregation ratio of less than 15% by mass (excellent in heat resistance storage stability of the developer)

○: a toner aggregation ratio of 15% by mass or more but less than 20% by mass (good in heat resistance storage stability of the developer)

Δ: a toner aggregation ratio of 20% by mass or more but less than 25% by mass (slightly poor in heat resistance storage stability of the developer)

x: a toner aggregation ratio of 25% by mass or more (poor in heat resistance storage stability of the developer, not usable)

(3) Charging Uniformity (Halftone Reproducibility)

By using each of the cyan developers 1 to 40 and the black developer 1, a halftone chart was copied by the evaluation machine, the image density of this image was measured at five points in the axis direction of the photoconductor, and then a variation in the image density was obtained. The image density was measured by using an image density meter (MACBETH RD914). Regarding the variation in the image density, a difference between the maximum value and the minimum value among the measurement, values of five points was calculated, and then the variation in the image density was calculated as a ratio (%) of the difference with respect to an average value of five points. The halftone reproducibility was evaluated based on the following evaluation criteria from the variation in the image density, and thus the charging uniformity of the toner was evaluated. The cases of having results of ⊙ to Δ are determined to be passing.

(Evaluation Criteria)

⊙: a variation in the image density of less than 10% (excellent)

○: a variation in the image density of 10% or more but less than 15% (good)

Δ: a variation in the image density of 15% or more but less than 20% x: a variation in the image density of 20% or more

The compositions of the binder resins and the evaluation results of the cyan developers 1 to 20 are presented in Table 3. The compositions of the binder resins and the evaluation results of the cyan developers 21 to 40 and the black developer 1 are presented in Table 4. In the tables, "C1" means a crystalline resin, and "X1" to "X3" mean amorphous resins.

TABLE 3

| | Cyan developer No. | Binder resin 1 Type | Binder resin 1 Amount (% by mass) | Binder resin 2 Type | Binder resin 2 Melting point (° C.) | Binder resin 2 Amount (% by mass) | Binder resin 3 Type | Binder resin 3 Amount (% by mass) | Evaluation Low-temperature fixability (° C.) | Evaluation High-temperature storage stability | Evaluation Halftone reproducibility |
|---|---|---|---|---|---|---|---|---|---|---|---|
| Example 1 | 1 | HB1 | 10 | C1 | 62 | 10 | X1 | 80 | 100 | ⊙ | Δ |
| Example 2 | 2 | HB2 | 10 | C1 | 62 | 10 | X1 | 80 | 100 | ○ | ⊙ |
| Example 3 | 3 | HB3 | 10 | C1 | 62 | 10 | X1 | 80 | 110 | ○ | ○ |
| Example 4 | 4 | HB4 | 10 | C1 | 62 | 10 | X1 | 80 | 110 | ○ | Δ |
| Example 5 | 5 | HB5 | 10 | C1 | 62 | 10 | X1 | 80 | 115 | ○ | Δ |
| Example 6 | 6 | HB6 | 10 | C1 | 62 | 10 | X1 | 80 | 100 | ○ | Δ |
| Example 7 | 7 | HB7 | 10 | C1 | 62 | 10 | X1 | 80 | 100 | Δ | Δ |
| Example 8 | 8 | HB8 | 10 | C1 | 62 | 10 | X1 | 80 | 95 | ⊙ | ⊙ |
| Example 9 | 9 | HB9 | 10 | C1 | 62 | 10 | X1 | 80 | 105 | ⊙ | ○ |
| Example 10 | 10 | HB10 | 10 | C1 | 62 | 10 | X1 | 80 | 105 | ⊙ | ⊙ |
| Example 11 | 11 | HB11 | 10 | C1 | 62 | 10 | X1 | 80 | 120 | ○ | Δ |
| Example 12 | 12 | HB12 | 10 | C1 | 62 | 10 | X1 | 80 | 110 | Δ | ○ |
| Example 13 | 13 | HB13 | 10 | C1 | 62 | 10 | X1 | 80 | 105 | ○ | ○ |
| Example 14 | 14 | HB8 | 1.5 | C1 | 62 | 10 | X1 | 88.5 | 105 | ○ | Δ |
| Example 15 | 15 | HB8 | 30 | C1 | 62 | 10 | X1 | 60 | 100 | ⊙ | Δ |
| Example 16 | 16 | HB8 | 10 | C1 | 62 | 10 | X2 | 80 | 110 | Δ | Δ |
| Example 17 | 17 | HB8 | 32 | C1 | 62 | 10 | X1 | 58 | 105 | ⊙ | Δ |
| Example 18 | 18 | HB14 | 10 | C1 | 62 | 10 | X1 | 80 | 100 | ○ | Δ |
| Example 19 | 19 | HB15 | 10 | C1 | 62 | 10 | X1 | 80 | 115 | Δ | ○ |
| Comparative Example 1 | 20 | HB16 | 10 | C1 | 62 | 10 | X1 | 80 | 100 | x | x |

TABLE 4

| | Cyan developer No. | Black developer No. | Binder resin 1 Type | Binder resin 1 Amount (% by mass) | Binder resin 2 Type | Binder resin 2 Melting point (° C.) | Binder resin 2 Amount (% by mass) | Binder resin 3 Type | Binder resin 3 Amount (% by mass) | Evaluation Low-temperature fixability (° C.) | Evaluation High-temperature storage stability | Evaluation Halftone reproducibility |
|---|---|---|---|---|---|---|---|---|---|---|---|---|
| Example 20 | 21 | — | HBC1 | 12.5 | — | — | — | X1 | 87.5 | 95 | ⊙ | Δ |
| Example 21 | 22 | — | HBC2 | 12.5 | — | — | — | X1 | 87.5 | 95 | ○ | ⊙ |
| Example 22 | 23 | — | HBC3 | 12.5 | — | — | — | X1 | 87.5 | 105 | ○ | ○ |
| Example 23 | 24 | — | HBC4 | 12.5 | — | — | — | X1 | 87.5 | 105 | ○ | Δ |
| Example 24 | 25 | — | HBC5 | 12.5 | — | — | — | X1 | 87.5 | 110 | ○ | Δ |
| Example 25 | 26 | — | HBC6 | 12.5 | — | — | — | X1 | 87.5 | 95 | ○ | Δ |
| Example 26 | 27 | — | HBC7 | 12.5 | — | — | — | X1 | 87.5 | 95 | Δ | Δ |
| Example 27 | 28 | — | HBC8 | 12.5 | — | — | — | X1 | 87.5 | 90 | ⊙ | ⊙ |
| Example 28 | 29 | — | HBC9 | 12.5 | — | — | — | X1 | 87.5 | 100 | ⊙ | ○ |
| Example 29 | 30 | — | HBC10 | 12.5 | — | — | — | X1 | 87.5 | 100 | ⊙ | ⊙ |
| Example 30 | 31 | — | HBC11 | 12.5 | — | — | — | X1 | 87.5 | 105 | ○ | Δ |
| Example 31 | 32 | — | HBC12 | 12.5 | — | — | — | X1 | 87.5 | 105 | Δ | ○ |
| Example 32 | 33 | — | HBC13 | 12.5 | — | — | — | X1 | 87.5 | 100 | ○ | ○ |
| Example 33 | 34 | — | HBC8 | 1.5 | — | — | — | X1 | 98.5 | 100 | ○ | Δ |
| Example 34 | 35 | — | HBC8 | 30 | — | — | — | X1 | 70 | 95 | ⊙ | Δ |
| Example 35 | 36 | — | HBC8 | 12.5 | — | — | — | X2 | 87.5 | 105 | Δ | Δ |
| Example 36 | 37 | — | HBC8 | 32 | — | — | — | X1 | 68 | 100 | ○ | Δ |
| Example 37 | 38 | — | HBC14 | 12.5 | — | — | — | X1 | 87.5 | 95 | ○ | Δ |
| Example 38 | 39 | — | HBC15 | 12.5 | — | — | — | X1 | 87.5 | 120 | Δ | ○ |
| Comparative Example 2 | 40 | — | HBC16 | 12.5 | — | — | — | X1 | 87.5 | 105 | x | x |
| Comparative Example 3 | — | 1 | HBC17 | 19.3 | X3 | | 77.3 | Y1 | 3.4 | 110 | x | Δ |

As clearly understood from Tables 3 and 4, all of the cyan developers 1 to 19 and 21 to 39 of Examples 1 to 38 exhibited sufficient performances in low-temperature fixability, high-temperature storage stability, and charging uniformity.

Further, for example, as clearly understood from Examples 1 to 11 and Examples 20 to 30, it is found that arachidyl alcohol, behenyl alcohol, 1-tetracosanol, 1-hexacosanol, octacosanol, palmitic acid, margaric acid, stearic acid, arachidic acid, behenic acid, and lignoceric acid are effective as a crystal nucleating agent.

Further, for example, as clearly understood from Examples 8, 12, 13, and 18, it is found that the fact that the content of the crystal nucleating agent part in the hybrid resin is 10% by mass or less is more effective from the viewpoint of enhancing charging uniformity.

Further, for example, as clearly understood from Examples 14, 15, and 17, it is found that as the content of the hybrid resin in the binder resin increases in the range up to 30% by mass, low-temperature fixability, high-temperature storage stability, and charging uniformity are exhibited with good balance.

Further, for example, as clearly understood from comparison between Examples 8 and 16 or comparison between Examples 27 and 35, it is found that the amorphous resin in the binder resin is more preferably a styrene-acrylic-based copolymer.

Further, for example, as clearly understood from comparison between Examples 8 and 19 or comparison between Examples 27 and 38, it is found that the crystal nucleating agent part is more preferably included in the side chain.

Further, for example, as clearly understood from Examples 27, 31, 32, and 37, it is found that the fact that the content of the crystal nucleating agent part in the hybrid crystalline resin is 10% by mass or less is more effective from the viewpoint of enhancing charging uniformity.

Further, for example, as clearly understood from Examples 27, 33, 34, and 36, it is found that as the content of the hybrid crystalline resin in the binder resin increases in the range up to 30% by mass, low-temperature fixability, high-temperature storage stability, and charging uniformity are exhibited with good balance.

On the other hand, Comparative Example 1 is not sufficient in both of high-temperature storage stability and charging uniformity. The reason for this is considered that the crystal nucleating agent part is not included in the hybrid resin.

Further, Comparative Example 2 is not sufficient in both of high-temperature storage stability and charging uniformity. The reason for this is considered that the crystal nucleating agent part is not included in the hybrid crystalline resin.

Further, Comparative Example 3 is not sufficient in high-temperature storage stability. The reason for this is considered that in a resin in which the crystal nucleating agent part is disposed at the terminal of the main chain of the crystalline resin unit, introduction into the inside of the toner parent particle is not sufficient.

According to an embodiment of the present invention, the low-temperature fixability and the charging uniformity of the toner are exhibited, and compatibilization of the binder resin components due to unintended external heat is suppressed. According to an embodiment of the present invention, improvement in the general versatility of the toner is expected as well as higher performance, higher speed, and energy saving in the electrophotographic image forming technique, and it is expected that the image forming technique becomes more popular.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A toner for developing an electrostatic latent image, the toner comprising a toner parent particle containing a binder resin, the binder resin including a crystalline resin and a hybrid resin, the hybrid resin having a main chain and a side chain, either one of or both of the main chain and the side chain including a unit derived from a crystal nucleating agent, the crystal nucleating agent being one or more compounds selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid, and a content of the hybrid resin in the binder resin being 1 to 30% by mass.

2. The toner according to claim 1, wherein the side chain includes the crystal nucleating' agent bonded to the main chain.

3. The toner according to claim 1, wherein a melting point of the crystal nucleating agent is higher than a melting point of the crystalline resin.

4. The toner according to claim 1, wherein the hybrid resin includes a vinyl-based resin unit.

5. The toner according to claim 1, wherein the binder resin further includes a vinyl-based resin.

6. A two-component developer comprising: the toner of claim 1 having the toner parent particle and an external additive present on a surface of the toner parent particle, and a carrier particle.

7. A toner for developing an electrostatic latent image, the toner comprising a toner parent particle containing a binder resin, the binder resin including a hybrid crystalline resin, the hybrid crystalline resin having a main chain, a first side chain bonded to the main chain, and a second side chain bonded to the main chain other than the first side chain, the first side chain including a crystalline resin unit, either one of or both of the main chain and the second side chain including a unit derived from a crystal nucleating agent, and the crystal nucleating agent being one or more compounds selected from the group consisting of arachidyl alcohol, behenyl alcohol, 1-tetracosanol, 1-hexacosanol, octacosanol, palmitic acid, margaric acid, stearic acid, arachidic acid, behenic acid, and lignoceric acid.

8. The toner according to claim 7, wherein the main chain includes an amorphous resin unit, and the second side chain includes the crystal nucleating agent bonded to the main chain.

9. The toner according to claim 8, wherein the amorphous resin unit is a vinyl-based resin unit.

10. The toner according to claim 7, wherein a melting point of the crystal nucleating agent is higher than a melting point of the hybrid crystalline resin.

11. The toner according to claim 7, wherein a content of the hybrid crystalline resin in the binder resin is 1 to 30% by mass.

12. The toner according to claim 7, wherein the binder resin further includes a vinyl-based resin.

13. A two-component developer comprising the toner of claim 7 having the toner parent particle and an external additive present on a surface of the toner parent particle, and a carrier particle.

* * * * *